US009170053B2

(12) United States Patent
Eckhoff et al.

(10) Patent No.: US 9,170,053 B2
(45) Date of Patent: Oct. 27, 2015

(54) TEMPERATURE-CONTROLLED PORTABLE COOLING UNITS

(71) Applicant: Tokitae LLC, Bellevue, WA (US)

(72) Inventors: Philip A. Eckhoff, Bellevue, WA (US); Nels R. Peterson, Bellevue, WA (US); Clarence T. Tegreene, Mercer Island, WA (US); Lowell L. Wood, Jr., Bellevue, WA (US)

(73) Assignee: Tokitae LLC, Bellevue, WA (US)

( * ) Notice: Subject to any disclaimer, the term of this patent is extended or adjusted under 35 U.S.C. 154(b) by 389 days.

(21) Appl. No.: 13/853,277

(22) Filed: Mar. 29, 2013

(65) Prior Publication Data

US 2014/0290293 A1 Oct. 2, 2014

(51) Int. Cl.
*F25D 23/12* (2006.01)
*F28C 3/08* (2006.01)

(52) U.S. Cl.
CPC ..... *F28C 3/08* (2013.01)

(58) Field of Classification Search
CPC ..... F24F 3/1423; F24F 5/0035; F25B 39/02
USPC ..... 62/216, 218, 259.4, 271, 480, 486
See application file for complete search history.

(56) References Cited

U.S. PATENT DOCUMENTS 4,007,601 A 2/1977 Webbon
4,057,029 A 11/1977 Seiter
4,924,676 A 5/1990 Maier-Laxhuber et al.
5,207,073 A 5/1993 Maier-Laxhuber et al.
5,359,861 A 11/1994 Maier-Laxhuber et al.
5,415,012 A 5/1995 Maier-Laxhuber et al.
5,440,896 A 8/1995 Maier-Laxhuber et al.
5,444,223 A 8/1995 Blama
5,518,069 A * 5/1996 Maier-Laxhuber et al. ..... 165/104.12
5,600,071 A 2/1997 Sooriakumar et al.
5,709,472 A 1/1998 Prusik et al.
5,740,680 A 4/1998 Lee
5,900,554 A 5/1999 Baba et al.
6,042,264 A 3/2000 Prusik et al.
6,378,326 B2 * 4/2002 Maier-Laxhuber et al. .... 62/480
6,438,992 B1 8/2002 Smith et al.
6,584,797 B1 7/2003 Smith et al.
6,688,132 B2 2/2004 Smith et al.
6,701,724 B2 3/2004 Smith et al.

(Continued)

OTHER PUBLICATIONS

U.S. Appl. No. 14/454,899, Chou et al.

(Continued)

*Primary Examiner* — Melvin Jones

(57) ABSTRACT

In some embodiments, a portable cooling unit for use with a storage container includes: a desiccant unit including at least one exterior wall defining an interior desiccant region, wherein the interior desiccant region is sealed from gas transfer between the interior desiccant region and a region external to the cooling unit; an evaporative cooling unit including at least one exterior wall defining an interior evaporative region, wherein the interior evaporative region is sealed from gas transfer between the interior evaporative region and the region external to the cooling unit; a vapor conduit including a first and a second end, the vapor conduit attached to the desiccant unit at the first end, the vapor conduit attached to the evaporative cooling unit at the second end, the vapor conduit forming a passageway between the interior desiccant region and the interior evaporative region; and a vapor control unit attached to the vapor conduit.

43 Claims, 12 Drawing Sheets

(56) References Cited

U.S. PATENT DOCUMENTS

| | | | | |
|---|---|---|---|---|
| 6,820,441 | B2 | 11/2004 | Maier-Laxhuber et al. | |
| 6,955,196 | B2 | 10/2005 | Giudici et al. | |
| 7,213,403 | B2 | 5/2007 | Maier-Laxhuber et al. | |
| 7,213,411 | B2 | 5/2007 | Maier-Laxhuber et al. | |
| 7,240,507 | B2 | 7/2007 | Jeuch | |
| 7,726,139 | B2 | 6/2010 | Maier-Laxhuber | |
| 2003/0230092 | A1 * | 12/2003 | Lowenstein et al. | 62/94 |

OTHER PUBLICATIONS

3M Monitor Mark™; "Time Temperature Indicators—Providing a visual history of time temperature exposure"; 3M Microbiology; 2006; pp. 1-4; located at http://multimedia.3m.com/mws/mediawebserver?mwsId—SSSSSufSevTsZxtUMx_9nxtBevUgevTSevTSevTSeSSSSSS===&fn-78-6901-2024-7.pdf.

BINE Informationsdienst; "Zeolite/water refrigerators, Projekt*info* 16/10"; BINE Information Service; printed on Feb. 12, 2013; pp. 1-4; FIZ Karlsruhe, Germany; located at: http://www.bine.info/fileadmin/content/Publikationen/Englische_Infos/projekt_1610_engl_internetx.pdf.

Cole-Parmer; "Temperature Labels and Crayons"; printed on Sep. 27, 2007; p. 1; located at: www.coleparmer.com.

Conde-Petit, Manuel R.; "Aqueous solutions of lithium and calcium chlorides:—Property formulations for use in air conditioning equipment design"; 2009; pp. 1-27 plus two cover pages; M. Conde Engineering, Zurich, Switzerland.

Cool-System Keg GmbH; "Cool-System presents: CoolKeg® The world's first self-chilling Keg!"; printed on Feb. 6, 2013; pp. 1-5; located at: http://www.coolsystem.de/.

Dawoud, et al.; "Experimental study on the kinetics of water vapor sorption on selective water sorbents, silica gel and alumina under typical operating conditions of sorption heat pumps"; International Journal of Heat and Mass Transfer; 2003; pp. 273-281; vol. 46; Elsevier Science Ltd.

Dometic S.A.R.L.; "Introduction of Zeolite Technology into refrigeration systems, LIFE04 ENV/LU/000829, Layman's Report"; printed on Feb. 6, 2013; pp. 1-10; located at: http://ec.europa.eu/environment/life/project/Projects/index.cfm?fuseaction=home.showFile&rep=file&fil=LIFE04_ENV_LU_000829_LAYMAN.pdf.

Dow Chemical Company; "Calcium Chloride Handbook: A Guide to Properties, Forms, Storage and Handling"; Aug. 2003; pp. 1-28.

Gast Manufacturing, Inc.; "Vacuum and Pressure Systems Handbook"; printed on Jan. 3, 2013; pp. 1-20; located at: http://www.gastmfg.com/vphb/vphb_sl.pdf.

Gea Wiegand; "Pressure loss in vacuum lines with water vapour"; printed on Mar. 13, 2013; pp. 1-2; located at: http://produkte.gea-wiegand.de/GEA/GEACategory/139/index_en.html.

Hall, Larry D.; "Building Your Own Larry Hall Icyball"; printed on Mar. 27, 2013; pp. 1-4; located at: http://crosleyautoclub.com/IcyBall/HomeBuilt/HallPlans/IB_Directions.html.

Kozubal, et al.; "Desiccant Enhanced Evaporative Air-Conditioning (DEVap): Evaluation of a New Concept in Ultra Efficient Air Conditioning, Technical Report NREL/TP-5500-49722"; National Renewable Energy Laboratory; Jan. 2011; pp. i-vii, 1-60, plus three cover pages and Report Documentation Page.

Machine-History.Com; "Refrigeration Machines"; printed on Mar. 27, 2013; pp. 1-10; located at: http://www.machine-history.com/Refigeration%20Machines.

Marquardt, Niels; "Introduction to the Principles of Vacuum Physics"; 1999; pp. 1-24; located at: http://www.cientificosaficionados.com/libros/CERN/vaciol-CERN.pdf.

Modern Mechanix; "Icyball Is Practical Refrigerator for Farm or Camp Use (Aug. 1930)"; bearing a date of Aug. 1930; printed on Mar. 27, 2013; pp. 1-3; located at: http://blog.modernmechanix.com/icyball-is-practical-refrigerator-for-farm-or-camp-use/.

Oxychem; "Calcium Chloride, A Guide to Physical Properties"; printed on Jan. 3, 2013; pp. 1-9, plus two cover pages and back page; Occidental Chemical Corporation; located at: http://www.cal-chlor.com/PDF/GUIDE-physical-properties.pdf.

Restuccia, et al.; "Selective water sorbent for solid sorption chiller: experimental results and modeling"; International Journal of Refrigeration; 2004; pp. 284-293; vol. 27; Elsevier Ltd and IIR.

Rezk, et al.; "Physical and operating conditions effects on silica gel/water adsorption chiller performance"; Applied Energy; 2012; pp. 142-149; vol. 89; Elsevier Ltd.

Rietschle Thomas; "Calculating Pipe Size & Pressure Drops in Vacuum Systems, Section 9—Technical Reference"; printed on Jan. 3, 2013; pp. 9-5 through 9-7; located at: http://www.ejglobalinc.com/Tech.htm.

Saha, et al.; "A new generation of cooling device employing $CaCl_2$-in-silica gel-water system"; International Journal of Heat and Mass Transfer; 2009; pp. 516-524; vol. 52; Elsevier Ltd.

Shockwatch; "Environmental Indicators"; printed on Sep. 27, 2007; pp. 12; located at: www.shockwatch.com.

UOP; "An Introduction to Zeolite Molecular Sieves"; printed on Jan. 10, 2013; pp. 1-20; located at: http://www.eltrex.pl/pdf/karty/adsorbenty/ENG-Introduction%20to%20Zeolite%20Molecular%20Sieves.pdf.

Wang, et al.; "Study of a novel silica gel-water adsorption chiller. Part I. Design and performance prediction"; International Journal of Refrigeration; 2005; pp. 1073-1083; vol. 28; Elsevier Ltd and IIR.

Wikipedia; "Icyball"; Mar. 14, 2013; printed on Mar. 27, 2013; pp. 1-4; located at: http://en.wikipedia.org/wiki/Icyball.

Pilatowsky, I., Romero, R.J., Isaza, C.A., Gamboa, S.A., Sebastian, P.J., and Rivera, W.; "Chapter 5: Sorption Refrigeration Systems"; Cogeneration Fuel Cell-Sorption Air Conditioning Systems; Green Energy and Technology; 2011; pp. 75-102; Springer; ISBN 978-1 84996-027-4.

Yong et al.; "Adsorption Refrigeration: A Survey of Novel Technologies"; Recent Patents on Engineering; 2007; pp. 1-21; vol. 1, No. 1; Bentham Science Publishers Ltd.

* cited by examiner

TEMPERATURE-CONTROLLED PORTABLE COOLING UNITS

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

None.

RELATED APPLICATIONS

None.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

SUMMARY

In some embodiments, a portable cooling unit configured for use with a storage container includes: a desiccant unit including at least one exterior wall substantially defining an interior desiccant region, wherein the interior desiccant region is substantially sealed from gas transfer between the interior desiccant region and a region external to the cooling unit; an evaporative cooling unit including at least one exterior wall substantially defining an interior evaporative region, wherein the interior evaporative region is substantially sealed from gas transfer between the interior evaporative region and the region external to the cooling unit; a vapor conduit including a first end and a second end, the vapor conduit attached to the desiccant unit at the first end, the vapor conduit attached to the evaporative cooling unit at the second end, the vapor conduit forming an internal, gas-impermeable passageway between the interior desiccant region and the interior evaporative region; and a vapor control unit attached to the vapor conduit.

In some embodiments, a portable cooling unit configured for use with a storage container includes: a desiccant unit including one or more external walls, the one or more external walls sealed together to form a gas-impermeable barrier around an interior desiccant region, the one or more external walls including an aperture; an evaporative cooling unit including one or more external walls, the one or more external walls sealed together to form a gas-impermeable barrier around an interior evaporative region, the one or more external walls including an aperture; a vapor conduit including a first end and a second end, the vapor conduit attached to an external surface of the one or more external walls surrounding the aperture of the desiccant unit at the first end, the vapor conduit attached to an external surface of the one or more external walls surrounding the aperture of the evaporative cooling unit at the second end, the vapor conduit forming an internal, gas-impermeable passageway between the interior desiccant region of the desiccant unit and the interior evaporative region of the evaporative cooling unit; and a vapor control unit attached to the vapor conduit.

In some embodiments, a portable cooling unit configured for use with a storage container includes: a desiccant unit including one or more external walls forming a substantially elongated structure around an interior desiccant region, the substantially elongated structure including an aperture proximal to one end; an evaporative cooling unit including one or more external walls forming a substantially elongated structure around an interior evaporative region, the substantially elongated structure including an aperture proximal to one end; a vapor conduit including a first end and a second end, the vapor conduit attached to an external surface surrounding the aperture of the desiccant unit at the first end, the vapor conduit attached to an external surface surrounding the aperture of the evaporative cooling unit at the second end, the vapor conduit forming an internal, gas-impermeable passageway between the interior desiccant region of the desiccant unit and the interior evaporative region of the evaporative cooling unit; and a vapor control unit integral to the vapor conduit.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
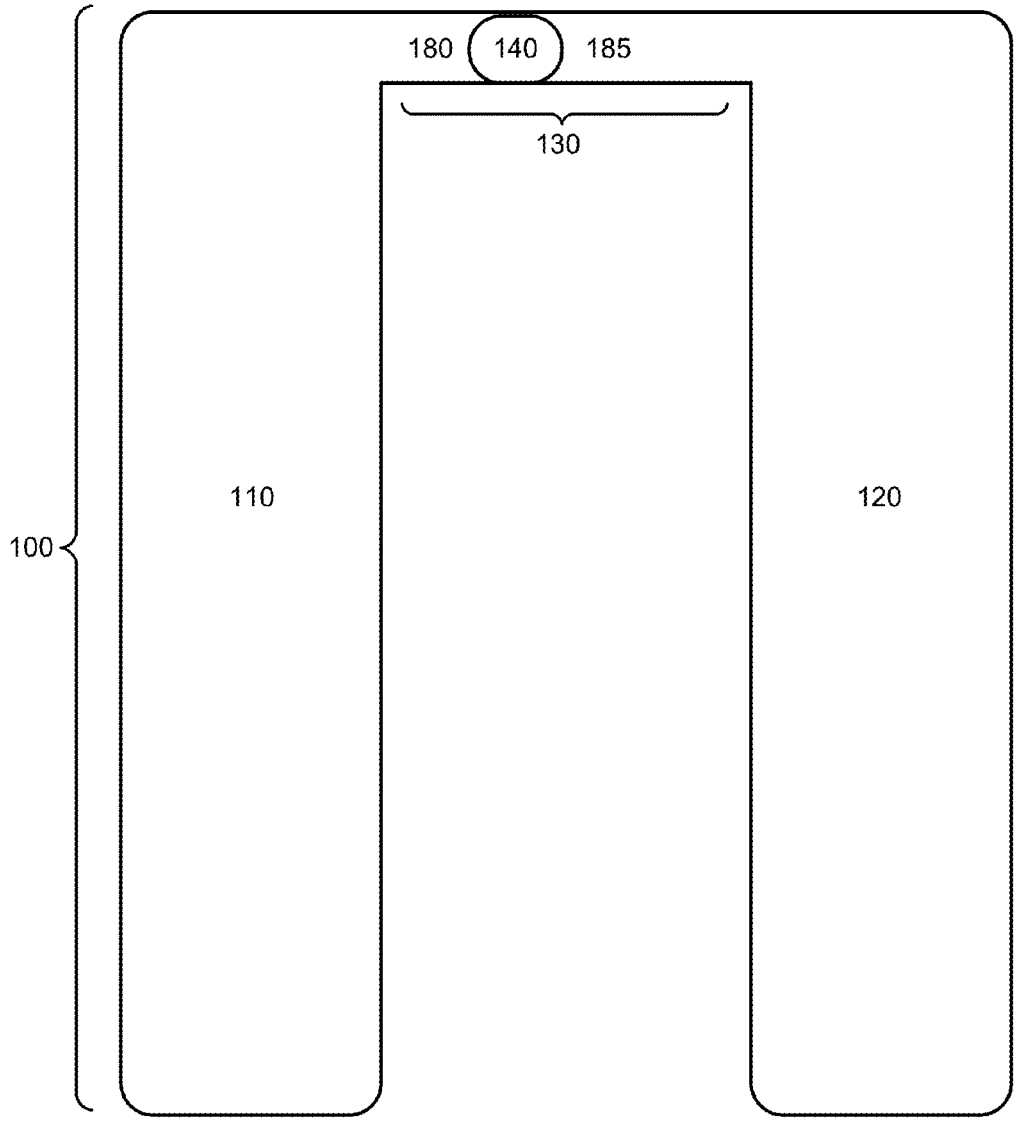
FIG. 1 is a schematic of a portable cooling unit configured for use with a storage container from an external view.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

The use of the same symbols in different drawings typically indicates similar or identical items unless context dictates otherwise.

Portable cooling units described herein include controlled evaporative cooling systems for use with containers. The portable cooling units include evaporative cooling systems that are calibrated and controlled to maintain the interior storage regions of the containers within a predetermined temperature range over a period of time, measured in days or weeks. In some embodiments, an evaporative cooling system is calibrated to maintain the interior storage region of a container in a predetermined temperature range between 0 degrees Centigrade and 10 degrees Centigrade. In some embodiments, an evaporative cooling system is calibrated to maintain the interior storage region of a container in a predetermined temperature range between 2 degrees Centigrade and 8 degrees Centigrade. Portable cooling units may be suitable, for example, for use in storage and/or shipping containers used with medicinal agents such as vaccines, where the storage temperature must be held in a temperature range above 0 degrees Centigrade to prevent freezing of the stored material. In some embodiments, the portable cooling system requires no external power to operate. In some embodiments, the portable cooling system requires minimal power to operate and control of the rate of evaporative cooling, such as a power requirement that is less than the power requirements of a standard refrigeration unit. In some embodiments, the evaporative cooling system within the cooling unit can be recharged, repaired or refreshed to allow reuse of the portable cooling unit multiple times.

FIG. 1 shows an external perspective of a portable cooling unit 100 configured for use with a storage container, according to an embodiment. The view illustrated in FIG. 1 is an external view of an embodiment of a portable cooling unit 100. The portable cooling unit 100 includes an evaporative unit 110, a vapor conduit 130, a vapor control unit 140 attached to the vapor conduit 130, and a desiccant unit 120. As shown in FIG. 1, each of the evaporative unit 110 and the desiccant unit 120 are substantially elongated structures of a substantially equal size and shape. In some embodiments, the evaporative unit 110 and the desiccant unit 120 are of disparate sizes and shapes. In some embodiments, the evaporative unit 110 and the desiccant unit 120 are configured to be substantially balanced along a center axis defined by the vapor conduit 130, for example to allow the portable cooling unit 100 to rest on a surface adjacent to the lower surface of the vapor conduit 130, without direct support to the evaporative unit 110 and the desiccant unit 120, during use of the portable cooling unit 100. For example, in some embodiments the desiccant unit 120 and the evaporative cooling unit 110 are of a size and shape to balance the portable cooling unit 100 against the vapor conduit 130. The portable cooling unit 100 depicted in FIG. 1 includes a first end 185 sealed to the desiccant unit 120 and a second end 180 sealed to the evaporative cooling unit 110. The vapor conduit 130 forms a gas-impermeable passageway between an interior region of the desiccant unit 120 and an interior region of the evaporative cooling unit 110.

The portable cooling unit 100 is constructed of a size and shape to be portable by an individual user. For example, in some embodiments the portable cooling unit 100 weighs less than 2 kilograms (kg). For example, in some embodiments the portable cooling unit 100 weighs less than 5 kilograms (kg). For example, in some embodiments the portable cooling unit 100 weighs less than 10 kilograms (kg). For example, in some embodiments the portable cooling unit 100 weighs less than 15 kilograms (kg). For example, in some embodiments the portable cooling unit 100 weighs less than 20 kilograms (kg). For example, in some embodiments the evaporative unit 110 and the desiccant unit 120 are approximately rectangular, with rough dimensions of 35 cm by 20 cm by 10 cm, joined with a vapor conduit 130 approximately 5 cm in diameter and 15 cm long. For example, in some embodiments the evaporative unit 110 and the desiccant unit 120 are substantially oval, with rough dimensions of 20 cm by 10 cm by 5 cm, joined with a vapor conduit 130 approximately 3 cm in diameter and 8 cm long. In some embodiments, the vapor conduit 130 is of sufficient size and strength to carry the mass of both the evaporative cooling unit 110 and the desiccant unit 120. For example, in some embodiments the evaporative cooling unit 110 and the desiccant unit 120 balance relative to the vapor conduit 130 during use. In these embodiments, the evaporative cooling unit 110 and the desiccant unit 120 can be fabricated with an equivalent size, shape and mass for stability of the portable cooling unit 100.

In some embodiments, the portable cooling unit 100 is configured to be single-use, and disposable or recyclable after the single use. For example, the portable cooling unit 100 can be fabricated substantially from recyclable plastic or metal. A portable cooling unit can be fabricated from a material with sufficient strength to retain its shape in the presence of an interior space gas pressure less than atmospheric pressure. For example, depending on the embodiment, one or more walls of a portable cooling unit can be fabricated from stainless steel, aluminum, polycarbonate plastic, glass, or other materials. In some embodiments, a portable cooling unit includes one or more sections that are translucent to allow a user to visualize the interior of an evaporative cooling unit and/or a desiccant unit. In some embodiments, the portable cooling unit 100 is configured to be reusable, such as after refreshment or recharge of the evaporative cooling unit 110 and the desiccant unit 120. For example, a portable cooling unit 100 can be configured to recharge the interior evaporative liquid and desiccant material through heating of the desiccant unit 120 between uses. See, e.g. FIG. 5 and associated text. For example, a portable cooling unit 100 can be configured to be opened and interior aspects, such as desiccant material and evaporative liquid, replaced between uses.

The vapor conduit 130 of the portable cooling unit 100 has a first end and a second end, each of the ends of the vapor conduit 130 respectively attached to the evaporative unit 110 and the desiccant unit 120 at a site adjacent to the top edge of each of the evaporative unit 110 and the desiccant unit 120. As used herein, a "conduit" refers to a structure with a hollow interior and at least two apertures at distal ends, such as a pipe, a tube or a duct. In some embodiments, the interior hollow of a conduit has a substantially round cross-section. In some embodiments, the interior hollow of a conduit has a cross-section that is substantially rectangular, elliptical, or irregularly shaped. A "vapor conduit," as used herein, refers to a conduit configured for gas, including evaporative liquid in a vapor form, to move through the conduit. In some embodiments, the vapor conduit 130, the evaporative unit 110 and the desiccant unit 120 are fabricated from individual components and then joined together with gas-impermeable seals. In some embodiments, the vapor conduit 130, the evaporative unit 110 and the desiccant unit 120 are substantially fabricated as a single unit, such as fabricated with blow-molded plastic or metal. For example, one or more of the components can be fabricated from a polycarbonate plastic. For example, one or more of the components can be fabricated from aluminum or stainless steel. The vapor conduit 130 is configured with sufficient strength and durability to support both the evaporative unit 110 and the desiccant unit 120 during use, such as if the portable cooling unit 100 is placed on a support under the vapor conduit 130. See, e.g. FIG. 4. The vapor conduit 130 is configured with sufficient strength and durability to support both the evaporative unit 110 and the desiccant unit 120 during transportation, such as if a user utilizes the vapor conduit 130 as a handle to carry the entire portable cooling unit 100. The vapor conduit includes a vapor control unit 140. Although the vapor control unit 140 is visible in the embodiment illustrated in FIG. 1, in some embodiments the vapor control unit 140 is entirely internal to the vapor conduit 130 and not externally visible to the cooling unit 100.

The portable cooling unit 100 includes a desiccant unit 120. In some embodiments, the portable cooling unit 100 includes a desiccant unit 120 including at least one exterior wall substantially defining an interior desiccant region, wherein the interior desiccant region is substantially sealed from gas transfer between the interior desiccant region and a region external to the portable cooling unit 100. For example, in some embodiments, the desiccant unit 120 can include exterior walls that are sealed to each other with gas-impermeable seals, forming an interior desiccant region substantially sealed from gas transfer between the interior desiccant region and a region external to the cooling unit 100. For example, in some embodiments, the desiccant unit 120 is formed from a single piece of fabrication material, such as blow-molded plastic or metal. In some embodiments, the portable cooling unit 100 includes a desiccant unit 120 including one or more external walls, the one or more external walls sealed together to form a gas-impermeable barrier around an interior desiccant region, the one or more external walls including an aperture. For example, in some embodiments the desiccant unit 120 can be constructed of a plurality of wall structures sealed together, wherein one of the walls can include an aperture in a region not adjacent to a seal. In some embodiments, the portable cooling unit 100 includes a desiccant unit 120 including one or more external walls forming a substantially elongated structure around an interior desiccant region, the substantially elongated structure including an aperture proximal to one end. For example, in some embodiments a desiccant unit 120 can include one or more external walls forming a substantially elongated structure that is substantially rectangular (see, e.g. FIG. 1). For example, in some embodiments a desiccant unit 120 can include one or more external walls forming a substantially elongated structure that is substantially oval. For example, in some embodiments a desiccant unit 120 can include one or more external walls forming a substantially elongated structure that is substantially oblong. The desiccant unit 120 will not become cool during use of the cooling unit, but will tend to warm up during use. Therefore, during use the desiccant unit 120 portion of the portable cooling unit 100 should not be placed adjacent to the to-be cooled storage area. In contrast, during use, the desiccant unit 120 should be placed in a position distal from, or external to, a to-be cooled storage area (see, e.g. FIG. 4).

The portable cooling unit 100 shown in FIG. 1 includes a single evaporative unit 110. In some embodiments, a portable cooling unit includes a plurality of evaporative units. For example, a plurality of evaporative units can be connected to a single vapor conduit in series or in parallel. In some embodiments, an evaporative unit 110 includes at least one exterior wall substantially defining an interior evaporative region, wherein the interior evaporative region is substantially sealed from gas transfer between the interior evaporative region and the region external to the cooling unit 100. For example, in some embodiments, the evaporative unit 110 can include exterior walls that are sealed to each other with gas-impermeable seals, forming an interior desiccant region substantially sealed from gas transfer between the interior desiccant region and a region external to the cooling unit 100. For example, in some embodiments, the evaporative unit 110 is formed from a single piece of fabrication material, such as blow-molded plastic or metal. In some embodiments, an evaporative unit 110 includes one or more external walls, the one or more external walls sealed together to form a gas-impermeable barrier around an interior evaporative region, the one or more external walls including an aperture. For example, in some embodiments the evaporative unit 110 can be constructed of a plurality of wall structures sealed together, wherein one of the walls can include an aperture in a region not adjacent to a seal. In some embodiments, an evaporative unit 110 includes one or more external walls forming a substantially elongated structure around an interior evaporative region, the substantially elongated structure including an aperture proximal to one end. For example, in some embodiments an evaporative unit 110 can include one or more external walls forming a substantially elongated structure that is substantially rectangular (see, e.g. FIG. 1). For example, in some embodiments an evaporative unit 110 can include one or more external walls forming a substantially elongated structure that is substantially oval. For example, in some embodiments an evaporative unit 110 can include one or more external walls forming a substantially elongated structure that is substantially oblong. During use, it is the evaporative unit 100 that will cool, therefore providing a cooling effect to an adjacent storage region. See, e.g., FIG. 4.

The portable cooling unit 100 shown in FIG. 1 includes a vapor conduit 130. The vapor conduit 130 includes a first end and a second end. In some embodiments, the vapor conduit 130 includes a first end and a second end, the vapor conduit attached to the desiccant unit 120 at the first end, the vapor conduit attached to the evaporative cooling unit 110 at the second end, the vapor conduit forming an internal, gas-impermeable passageway between the interior desiccant region and the interior evaporative region. For example, in some embodiments a first end and a second end of the vapor conduit 130 can be sealed to the respective surfaces of the desiccant unit 120 and the evaporative cooling unit 110 with gas-impermeable seals. Depending on the material used in fabrication, the vapor conduit 130 can be sealed at one or both ends, for example, with epoxy, a crimp structure, or solder. In some embodiments, the portable cooling unit 100 structure is manufactured in a single piece including the vapor conduit 130, the desiccant unit 120 and the evaporative cooling unit 110. For example, the portable cooling unit 100 structure can be manufactured from blow-molded plastic or metal. In some embodiments, the vapor conduit 130 includes a first end and a second end, the vapor conduit attached to an external surface of the one or more external walls surrounding the aperture of the desiccant unit 120 at the first end, the vapor conduit attached to an external surface of the one or more external walls surrounding the aperture of the evaporative cooling unit 110 at the second end, the vapor conduit forming an internal, gas-impermeable passageway between the interior desiccant region of the desiccant unit 120 and the interior evaporative region of the evaporative cooling unit 110. In some embodiments, the vapor conduit 130 includes a first end and a second end, the vapor conduit attached to an external surface surrounding the aperture of the desiccant unit 120 at the first end, the vapor conduit attached to an external surface surrounding the aperture of the evaporative cooling unit 110 at the second end, the vapor conduit forming an internal, gas-impermeable passageway between the interior desiccant region of the desiccant unit 120 and the interior evaporative region of the evaporative cooling unit 110.

As shown in FIG. 1, a vapor control unit 140 is attached to the vapor conduit 130. In some embodiments, the vapor control unit 140 is entirely internal to the vapor conduit 130 and not externally visible to the cooling unit 100. In some embodiments, the vapor control unit 140 is integral to the vapor conduit 130. The vapor control unit 140 controllably increases and decreases the interior dimensions of a conduit internal to the vapor control unit 140, which serves to alter the rate of vapor flow through the vapor control unit 140 and, therefore, between the first end 185 of the vapor conduit and the second end 180 of the vapor conduit. See: "Calculating Pipe Sizes & Pressure Drops in Vacuum Systems," Section 9—Technical Reference, Rietschle Thomas Company, which is incorporated by reference.

Figure 2:
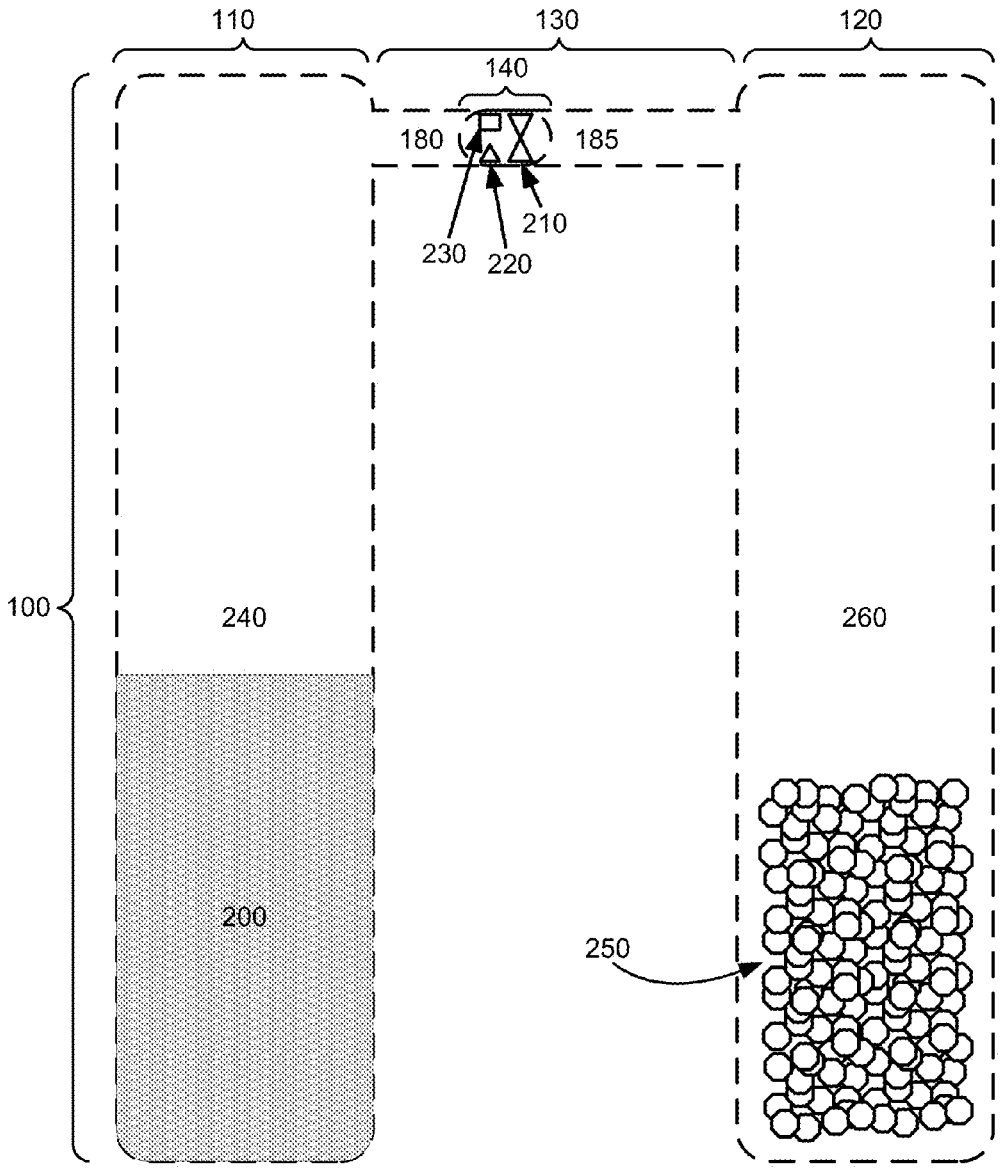
FIG. 2 is a schematic of a portable cooling unit configured for use with a storage container from a cross-section view.

FIG. 2 illustrates additional aspects of an embodiment of a portable cooling unit 100. FIG. 2 illustrates a portable cooling unit 100 in vertical cross-section to depict aspects of the interior of the portable cooling unit 100 that are not visible in an external view (e.g. as FIG. 1). FIG. 2 depicts a portable cooling unit 100 including a desiccant unit 120 and a evaporative cooling unit 110 with a vapor conduit 130 attached to the desiccant unit 120 at a first end 185 and to the evaporative cooling unit 110 at a second end 180.

FIG. 2 illustrates aspects of the desiccant unit 120. The exterior wall of the desiccant unit 120 can be fabricated from a variety of materials, depending on the embodiment. The exterior wall can be fabricated from a material with sufficient strength to retain its shape in the presence of an interior desiccant region 260 gas pressure less than atmospheric pressure. For example, depending on the embodiment, the exterior wall can be fabricated from stainless steel, aluminum, polycarbonate plastic, glass, or other materials. In some embodiments, the desiccant unit 120 is fabricated from 3% to 5% aluminum foam which is substantially deformed around the interior desiccant material 250. In some embodiments, the desiccant unit 120 is formed from a single piece of fabrication material. In some embodiments, the main structure of the portable cooling unit 100, including the desiccant unit 120, the evaporative cooling unit 110 and the vapor conduit 130, is formed from a single piece of fabrication material. For example, one or more sections of the portable cooling unit 100 can be fabricated from blow-molded plastic or metal. In some embodiments, an exterior wall of the desiccant unit 120 includes an aperture positioned adjacent to an interior of the vapor conduit 130, the first end 185 of the vapor conduit 130 sealed to the exterior wall of the desiccant unit 120 at a surface surrounding the aperture. In some embodiments, the desiccant unit 120 can include an interior liner positioned adjacent to the exterior wall. For example, an interior liner can be configured to protect the material of the exterior wall from any possible corrosion from the desiccant material 250 utilized in a specific embodiment.

The desiccant unit 120 includes an interior desiccant region 260. A plurality of units of desiccant material 250 are positioned within the interior desiccant region 260. Although the units of desiccant material 250 are illustrated as a mass, in some embodiments they may be arrayed in a regular pattern to promote maximum surface contact of the desiccant material 250 with the gas within the interior desiccant region 260 of the desiccant unit 120. In some embodiments, the units of desiccant material 250 include other materials or structures configured to promote maximum surface contact of the desiccant material 250 with the gas within the interior desiccant region 260 of the desiccant unit 120. In some embodiments, the exterior wall of the desiccant unit 120 provides a gas-impermeable barrier around the interior desiccant region 260. In some embodiments, an interior wall or liner forms a gas-impermeable barrier around the interior desiccant region 260. The interior desiccant region 260 includes space that is sealed at a gas pressure less than the exterior region of the portable cooling unit 100. For example, the desiccant unit 120 can include a gas pressure less than atmospheric pressure within the interior desiccant region 260.

FIG. 2 depicts a plurality of units of desiccant material 250 within the desiccant unit 120. A plurality of units of desiccant material 250 are positioned within the interior desiccant region 260 of the desiccant unit 120. Although the units of desiccant material 250 are illustrated as a mass, in some embodiments they may be arrayed in a regular pattern to promote maximum surface contact of the desiccant material 250 with the gas within the interior space 260 of the desiccant unit 120. In some embodiments, the units of desiccant material 250 include a structure or a coating of a size and shape to promote gas circulation around each of the units of desiccant material 250. A gas-filled interior desiccant region 260 provides gas contact between the desiccant material 250 and the interior of the adjacent end of the vapor conduit 130. In some embodiments, the desiccant unit 120 includes a vapor-sealed chamber including an interior desiccant region 260 in vapor contact with an interior region of the vapor conduit 130. In some embodiments, the desiccant unit 120 includes a vapor-impermeable region within the desiccant unit 120, the vapor-impermeable region in vapor contact with the interior of the vapor conduit 130. In some embodiments, the desiccant unit 120 can include an interior liner positioned adjacent to a wall. For example, an interior liner can be configured to protect the material of an outer wall from any possible corrosion from the desiccant material 260 utilized in a specific embodiment.

The units of desiccant material 250 are fabricated from at least one material with desiccant properties, or the ability to remove liquid from a liquid vapor in the surrounding space. Units of desiccant material 250 can operate, for example, through the absorption or adsorption of water from the water vapor in the surrounding space. One or more units of desiccant material 250 selected will depend on the specific embodiment, particularly the volume required of a sufficient quantity of desiccant material to absorb liquid for the estimated time period required to operate a specific evaporative cooling unit integral to a specific container. In some embodiments, the units of desiccant material 250 selected will be a solid material under routine operating conditions. One or more units of desiccant material 250 can include non-desiccant materials, for example binding materials, scaffolding materials, or support materials. One or more units of desiccant material 250 can include desiccant materials of two or more types. The portable cooling units described herein are intended for use with evaporative cooling for days or weeks, and sufficient desiccant material and corresponding evaporative liquid is included for those time periods in any given embodiment. For more information on liquid-desiccant material pairs, see: Saha et al., "A New Generation Cooling Device Employing $CaCl_2$-in-silica Gel-water System," *International Journal of Heat and Mass Transfer,* 52: 516-524 (2009), which is incorporated by reference. The selection of one or more desiccant materials 250 for use in a specific embodiment will also depend on the target cooling temperature range in a specific embodiment. For example, in some embodiments the desiccant material can include calcium carbonate. For example, in some embodiments, the desiccant material can include lithium chloride. For example, in some embodiments, the desiccant material can include liquid ammonia. For example, in some embodiments, the desiccant material can include zeolite. For example, in some embodiments, the desiccant material can include silica. More information regarding desiccant materials is available in: Dawoud and Aristov, "Experimental Study on the Kinetics of Water Vapor Sorption on Selective Water Sorbents, Silica Gel and Alumina Under Typical Operating Conditions of Sorption Heat Pumps," *International Journal of Heat and Mass Transfer,* 46: 273-281 (2004); Conde-Petit, "Aqueous Solutions of Lithium and Calcium Chlorides: —Property Formulations for Use in Air Conditioning Equipment Design," *M. Conde Engineering*, (2009); "Zeolite/Water Refrigerators," BINE Informationsdienst, projektinfo 16/10; "Calcium Chloride Handbook: A Guide to Properties, Forms, Storage and Handling," Dow Chemical Company, (August, 2003); "Calcium Chloride, A Guide to Physical Properties," Occidental Chemical Corporation, Form No. 173-01791-0809P&M; and Restuccia et al., "Selective Water Sorbent for Solid Sorption Chiller: Experimental Results and Modelling," *International Journal of Refrigeration* 27:284-293 (2004), which are each incorporated herein by reference. In some embodiments, a desiccant material is considered non-toxic under routine handling precautions. The selection of a desiccant material is also dependent on any exothermic properties of the material, in order to retain the thermal properties of the entire portable cooling unit desired in a specific embodiment.

Some embodiments include a gas vent mechanism configured to allow gas with pressure beyond a preset limit to vent externally from the desiccant unit 120. For example, the external wall of the desiccant unit 120 can include a region configured to break when the internal pressure rises above a threshold level. For example, the desiccant unit 120 can include an additional one-way valve in an external wall, the one-way valve connected to a region external to the desiccant unit 120 and configured to open in response to excessive gas pressure and/or heat within the interior desiccant region 260 of the desiccant unit 120. Some embodiments include a gas vent mechanism configured to allow gas of a temperature beyond a preset threshold limit to vent externally from the desiccant unit 120. For example, a desiccant unit 120 can include a temperature sensor, such as a thermocouple, within the interior desiccant region 260 of the desiccant unit 120, the temperature sensor operably connected to a one-way valve configured to vent gas from the interior desiccant region 260 if the temperature is above a preset threshold value.

The desiccant unit 120 is attached to the vapor conduit 130. The vapor conduit 130, including the vapor control unit 140, is configured to control vapor flow between the interior desiccant region 260 of the desiccant unit 120 and the interior evaporative region 240 of the evaporative cooling unit 110. As shown in FIG. 2, in some embodiments the vapor conduit 130 is configured as a tubular structure traversing the single access conduit 130 of the container 100. The vapor conduit 130 is configured to allow sufficient gas, including evaporated vapor, to move to the interior desiccant region 260 of the desiccant unit 120 in situations where maximum evaporative cooling of the container is desired. Therefore, the size, shape and placement of the vapor conduit 130 will depend on factors including the size of the container, the temperature ranges desired for the container, the level of reversible control of vapor movement within the vapor conduit, and the physical properties of the desiccant material and the liquid utilized in a particular embodiment. For example, in some embodiments the target temperature range of the storage region is between 0 and 10 degrees Centigrade, and the portable cooling unit 100 includes approximately 1 liter of liquid water and a corresponding volume of desiccant material including calcium chloride to absorb greater than 1 liter of water. See "The Calcium Chloride Handbook, A Guide to Properties, Forms, Storage and Handling," DOW Chemical Company, dated August 2003, which is incorporated by reference herein. As an example, for an embodiment of a portable cooling unit with water as an evaporative liquid and calcium chloride as a desiccant material, wherein the portable cooling unit begins with a substantially evacuated interior (i.e. less than or equal to 300 mTorr of pressure), it is estimated that approximately 1 gram of water will evaporate for every hour that the valve is in a fully open position. Therefore, 1 liter of water and 1.5 kg of calcium chloride can maintain the evaporative cooling unit between approximately 6 degrees Centigrade and 9 degrees Centigrade for approximately a month with an external ambient temperature of approximately 25 degrees Centigrade. FIG. 2 illustrates that some embodiments include a sensor 220 within the vapor control unit 140, operably connected to the controller with a wire connection. Some embodiments include a plurality of temperature sensors.

As shown in FIG. 2, an evaporative cooling unit 110 includes an interior evaporative region 240. The interior evaporative region 240 includes an evaporative liquid 200 within the interior evaporative region 240 of the evaporative cooling unit 110. An "evaporative liquid," a used herein, is a liquid with evaporative properties under the expected temperatures and gas pressures of the interior region of an evaporative unit during use of a portable cooling unit. For example, in some embodiments the interior evaporative region of an evaporative unit includes a partial gas pressure of approximately 5% of atmospheric pressure external to the portable cooling unit, and the evaporative liquid within the interior evaporative region includes water. For example, in some embodiments the interior evaporative region of an evaporative unit includes a partial gas pressure of approximately 10% of atmospheric pressure external to the portable cooling unit, and the evaporative liquid within the interior evaporative region includes methanol. For example, in some embodiments the interior evaporative region of an evaporative unit includes a partial gas pressure of approximately 15% of atmospheric pressure external to the portable cooling unit, and the evaporative liquid within the interior evaporative region includes ammonia. For example, in some embodiments the evaporative liquid can include additional agents to promote or reduce the evaporative potential of the evaporative liquid.

In some embodiments, the exterior wall of the evaporative cooling unit 110 provides a gas-impermeable barrier around the interior evaporative region 240. In some embodiments, an interior wall or liner forms a gas-impermeable barrier around the interior evaporative region 240. The interior evaporative region 240 includes space that is sealed at a gas pressure less than the exterior region of the portable cooling unit 100. For example, evaporative cooling unit 110 can include a gas pressure less than atmospheric pressure within the evaporative cooling unit 110. The exterior wall of the evaporative cooling unit 110 can be fabricated from a variety of materials, depending on the embodiment. The exterior wall can be fabricated from a material with sufficient strength to retain its shape in the presence of an interior evaporative region 240 gas pressure less than atmospheric pressure. The exterior wall can be fabricated from a material with sufficient strength to retain its shape in the presence of an interior evaporative region 240 including an evaporative liquid of a predetermined mass. For example, depending on the embodiment, the exterior wall can be fabricated from stainless steel, aluminum, polycarbonate plastic, glass, or other materials. In some embodiments, the evaporative cooling unit 110 is formed from a single piece of fabrication material. In some embodiments, the main structure of the portable cooling unit 100, including the desiccant unit 120, the evaporative cooling unit 110 and the vapor conduit 130, is formed from a single piece of fabrication material. For example, one or more sections of the portable cooling unit 100 can be fabricated from blow-molded plastic or metal. In some embodiments, an exterior wall of the evaporative cooling unit 110 includes an aperture positioned adjacent to an interior of the vapor conduit 130, the end of the vapor conduit 130 sealed to the exterior wall of the evaporative cooling unit 110 at a surface surrounding the aperture. In some embodiments, the evaporative cooling unit 110 can include an interior liner positioned adjacent to the exterior wall. For example, an interior liner can be configured to protect the material of the exterior wall from any possible corrosion from the liquid 200 utilized in a specific embodiment.

As illustrated in FIG. 2, in some embodiments the evaporative cooling unit 110 includes an interior evaporative region 240 with an upper region, the upper region positioned adjacent to an aperture in the outer wall, a lower region, the lower region positioned below the upper region, and a liquid positioned substantially within the lower region. During use, in some embodiments the portable cooling unit 100 is configured to maintain the liquid 200 within the interior evaporative region 240 of the evaporative cooling unit 110 by gravity.

FIG. 2 illustrates a vapor conduit 130 with a gas-impermeable interior region connecting the gas-impermeable region of the interior evaporative region 240 of the evaporative cooling unit 200 and the gas-impermeable region of the interior desiccant region 260 of the desiccant unit 120. The interior of the vapor conduit 130, the interior evaporative region 240 and the interior desiccant region 260 are sealed together to create a substantially gas-sealed interior of the portable cooling unit 100. Some embodiments include a persistent gas pressure below atmospheric pressure within the interior desiccant region 260 of the desiccant unit 120, the interior evaporative region 240 of the evaporative unit 110, and the internal, gas-impermeable passageway of the vapor conduit 130. In some embodiments, the interior desiccant region 260 of the desiccant unit 120, the interior evaporative region 240 of the evaporative unit 110, and the internal, gas-impermeable passageway of the vapor conduit 130 form a substantially gas-impermeable interior of the portable cooling unit 100.

In some embodiments, the vapor conduit 130 includes: a gas-impermeable wall of the vapor conduit 130; a gas-impermeable seal between the first end of the vapor conduit 130 and the desiccant unit 120; and a gas-impermeable seal between the second end of the vapor conduit 130 and the evaporative cooling unit 110. The vapor conduit 130 is of sufficient size and shape to permit free flow of gas between the interior evaporative region 240 and the interior desiccant region 260, depending on the configuration of the vapor control unit 140. In some embodiments, the vapor conduit 130 is substantially round along its width. In some embodiments, the vapor conduit 130 is flattened along one or more sections, for example at a face of the vapor conduit 130 positioned adjacent to a surface of a container during use (see, e.g. FIG. 4). In some embodiments, the vapor conduit 130 includes a substantially tubular structure of sufficient length to inhibit thermal conduction between the at least one external wall of the desiccant unit 120 and the at least one external wall of the evaporative cooling unit 110. In some embodiments, the vapor conduit 130 is configured to minimize conduction of thermal energy between the desiccant unit 120 and the evaporative cooling unit 110. For example, the vapor conduit 130 can be configured to position the desiccant unit 120 and the evaporative cooling unit 110 to minimize conduction of thermal energy through the air between them. For example, the vapor conduit 130 can be configured to form an elongated thermal pathway between the desiccant unit 120 and the evaporative cooling unit 110. For example, the vapor conduit 130 can be fabricated from low thermal conduction materials, such as fiberglass or polycarbonate plastic. In some embodiments, the vapor conduit 130 is curved. In some embodiments, the vapor conduit 130 is substantially straight along its long axis (e.g. as illustrated in FIG. 2).

A vapor conduit 130 is positioned substantially between the evaporative unit 110 and the desiccant unit 120. The vapor conduit 130 includes a first end 185 and a second end 180. The first end 185 is sealed to the desiccant unit 120 and the second end 180 is sealed to the evaporative unit 110, thereby creating a controllable vapor pathway between the interior space 260 of the desiccant unit 120 and the interior evaporative region 240 of the evaporative unit 110. The vapor conduit 130 is of a size and shape to permit free gas flow between the interior space 260 of the desiccant unit 120 and the interior evaporative region 240 of the evaporative unit 110 when the valve of the vapor control unit is in a fully open position. In some embodiments, the vapor conduit 130 is a substantially round, tubular structure. In some embodiments, the vapor conduit 130 is a substantially flattened structure. In some embodiments, the vapor conduit 130 is a plurality of closely associated structures, e.g. a series of substantially parallel tubular structures. The interior dimensions of the vapor conduit 130 vary depending on the size of the portable cooling unit 100, interior space 260 of the desiccant unit 120, the interior evaporative region 240 of the evaporative unit 110, and the vapor control unit. The vapor conduit 130 is of a size and shape to permit gas and vapor to flow freely and without substantial hindrance between the interior space 260 of the desiccant unit 120 and the interior evaporative region 240 of the evaporative unit 110 when the valve of the vapor control unit is in a fully open position.

A vapor control unit 140 is attached to the vapor conduit 130. Included within the vapor conduit 130 is a vapor control unit 140. In some embodiments, a vapor control unit is integral to a vapor conduit. In the embodiment illustrated in FIG. 2, the vapor control unit 140 is integral to, and substantially internal to, the vapor conduit 130. The vapor control unit 140 includes a valve 210 and a controller 230. The controller 230 is operably connected to the sensor 220 with a wire connection. The controller 230 is operably connected to the valve 210 within the vapor control unit 140. In some embodiments, the vapor control unit 140 includes: a thermocouple unit configured to respond to the temperature of vapor in the vapor conduit 130; a valve 210 configured to regulate vapor flow through the vapor conduit 130; and a controller 230 operably connected to the thermocouple unit and to the valve 210. In some embodiments, the vapor control unit 140 can be integral to the vapor conduit 130. In some embodiments, the vapor control unit 140 is entirely internal to the vapor conduit 130. In some embodiments, the vapor control unit 140 spans the wall of the vapor conduit 130. In some embodiments, the vapor control unit 140 traverses the wall of the vapor conduit 130. In some embodiments, the vapor control unit 140 includes: a valve 210 configured to control the movement of gas through the internal passageway of the vapor conduit 130 between the interior desiccant region 260 of the desiccant unit 120 and the interior evaporative region 240 of the evaporative cooling unit 110; a controller 230 operably connected to the at least one valve 210; and a sensor 220. In some embodiments, a vapor control unit 140 includes a power source, such as a battery, operably connected to one or more other components. The vapor control unit 140 can be configured to operate automatically, without external user control. The vapor control unit 140 can be configured to operate semi-automatically, with minimal external user control. For example, a vapor control unit 140 can be configured to operate after a user has entered specific parameters, such as a temperature range for the evaporative cooling unit 110, on an external keypad. For example, a vapor control unit 140 can be configured to control the rate of evaporative cooling in the portable cooling unit 100 after receiving user input specifying, from an operably attached key pad, a target temperature range between −5 degrees Centigrade and −15 degrees Centigrade for the evaporative cooling unit 110.

In the embodiment illustrated in FIG. 2, the vapor control unit 140 includes a single valve 210. In some embodiments, the vapor control unit 140 includes a plurality of valves configured to operate in series or in parallel. For example, in some embodiments a vapor control unit includes a plurality of valves in series along a single conduit within the vapor control unit. For example, in some embodiments a vapor control unit includes a plurality of valves each attached to a separate conduit within the vapor control unit 140, each of the plurality of valves reversibly controllable to open and close the attached conduit.

The valve 210 is configured to reversibly control the flow of gas, including vapor, through the vapor conduit 130. In some embodiments, the vapor control unit 140 includes a valve 210 configured to restrict the transfer of gas between the first end of the vapor conduit 130 and the second end of the vapor conduit 130. In some embodiments, the valve 210 includes at least one movable valve with at least a first position substantially closing the at least one movable valve to vapor flow through the at least one movable valve, and a second position substantially opening the at least one movable valve to vapor flow through the at least one movable valve. Some embodiments include a movable valve with at least a first position substantially closing vapor flow through the vapor control unit, at least one second position substantially permitting flow of vapor through the vapor control unit to the maximum permitted by the diameter of the vapor control unit, and at least one third position restricting vapor flow through the vapor control unit. In some embodiments, the valve 210 includes a mechanical valve. In some embodiments, the valve 210 includes a gate valve. In some embodiments, the valve 210 includes rotary valve, such as a butterfly valve. In some embodiments, the valve 210 includes a ball valve. In some embodiments, the valve 210 includes a piston valve. In some embodiments, the valve 210 includes a globe valve. In some embodiments, the valve 210 includes a plurality of valves operating in tandem with each other. In some embodiments, the valve 210 includes an electronically-controlled valve. In some embodiments, the valve 210 includes a mechanically-controlled valve. The selection of the valve 210 in a given embodiment depends on, for example, cost, weight, the sealing properties of a type of valve, the estimated failure rate of a type of valve, the durability of a type of valve under expected use conditions, and the power consumption requirements for a type of valve. The selection of the valve 210 in a given embodiment also depends on the level of restriction of gas flow, including vapor flow, through a particular type of valve when the valve is in a fully open position.

Also included within the vapor control unit 140 is a controller 230. The controller 230 is operably connected to the valve 210. The valve 210 is operably connected to the controller 230, and configured to be responsive to the controller 230. The controller 230 is configured to respond to one or more sensors 220 by acting to alter the position of the valve 210. The controller 230 is configured to respond in a specific manner depending on the temperature detected by the one or more sensors 220. For example, a controller 230 can be configured to respond to a temperature reading from a temperature sensor that is above a threshold temperature value by the controller acting to cause an opening of the valve 210. For example, a controller 230 can be configured to respond to a temperature reading below a threshold temperature value from a temperature sensor by acting to cause closure of the valve 210. For example, a controller 230 can be configured to respond to a temperature within a temperature range by acting to cause partial opening of the valve 210. For example, a controller 230 can be configured to respond to a temperature within a temperature range by acting to cause partial closure of the valve 210.

Different types of controllers can be utilized, depending on the embodiment. For example, a controller 230 can be an electronic controller. In some embodiments, a controller 230 is an electronic controller that accepts data from a plurality of temperature sensors and initiates action by the valve 210 after determination of an average temperature from the accepted data. An electronic controller can include logic and/or circuitry configured to create a bounded or threshold system around a particular range of values from one or more sensors, such as a bounded system around a range of 3 degrees Centigrade to 7 degrees Centigrade, responsive to data from one or more temperature sensors. For example, in some embodiments a controller 230 is a "bang-bang" controller operably attached the valve 210 and configured to be responsive to a temperature sensor that includes a thermocouple. An electronic controller can include logic and/or circuitry configured to create a feedback system around a particular range of values from one or more sensors 220, such as a feedback system around a range of 2 degrees Centigrade to 8 degrees Centigrade, responsive to data from one or more temperature sensors. For example, in some embodiments a controller 230 is a mechanical controller. For example, in some embodiments the controller 230 is attached to a Bourdon tube operably connected to the valve 210, and configured to respond to changes in vapor pressure associated with temperature differences. Embodiments including a mechanical controller can also include a connector that forms an operable connection between the controller and the valve that is a mechanical connector. For example, a mechanical connector can be a connector configured to transmit physical pressure, such as through operation of one or more rods or cogs, between the controller and the valve. In some embodiments, a controller 230 is an electronic controller that accepts data from a plurality of temperature sensors and initiates action by the valve 210 after determination of an average temperature from the accepted data.

Although a connection is not illustrated in FIG. 2 between the controller 230 and the valve 210, an operable connection exists between the controller 230 and the valve 210. For example, in some embodiments, the operable connection includes a connector configured to transmit physical pressure, such as a rod or cog. For example, in some embodiments, the operable connection includes a connector configured to transmit electronically, such as through a wire or wireless connection, such as through an IR or short wavelength radio transmission (e.g. Bluetooth).

In the embodiment shown in FIG. 2, a sensor 220 is positioned within the vapor conduit 130 at a position adjacent to the end of the vapor conduit 130 within the interior of the portable cooling unit 100. In some embodiments, a sensor 220 is configured to detect the temperature of the gas present in the interior of the vapor conduit 130. In some embodiments, a sensor 220 is configured to detect the partial pressure of the gas present in the interior of the vapor conduit 130. Some embodiments include a sensor 220 that is a temperature sensor configured to detect the temperature of the gas present in the interior of the vapor conduit 130. The sensor 220 illustrated in FIG. 2 is positioned adjacent to the vapor control unit 140 at the side of the vapor control unit 140 adjacent to the interior of the unit 100. In some embodiments, a temperature sensor is positioned within the vapor control unit 140 at a region within the vapor conduit 130. In some embodiments, a temperature sensor is positioned within the vapor conduit 130 at a region within the interior of the evaporative unit 110, such as within the internal evaporative region 240, and configured to detect the temperature of evaporative liquid 200 within the internal evaporative region 240. In some embodiments, a temperature sensor is positioned within the vapor conduit 130 at a region within the interior of the unit, such as within the internal evaporative region 240, and configured to detect the temperature of gas within the internal evaporative region 240. Some embodiments include a plurality of temperature sensors positioned in series or parallel. A sensor 220 can include, for example, depending on the embodiment, an electronic temperature sensor, a chemical temperature sensor, or a mechanical temperature sensor. A sensor 220 can include, for example, a low-energy temperature sensor, such as a Thermodo device (Robocat, Copenhagen, Denmark). A sensor 220 can include, for example, depending on the embodiment, an electronic gas pressure sensor, or a mechanical gas pressure sensor. A sensor 220 for measurement of gas pressure can include a Bourdon tube. A sensor 220 for measurement of gas pressure can include a diaphragm-based gas pressure sensor. A sensor 220 for measurement of temperature can include, for example, a thermocouple. A sensor 220 can include a combined sensor of gas pressure, gas composition, and temperature. For example, a sensor 220 can include a NODE device, (Variable Technologies, Chattanooga Tenn.). In some embodiments, a sensor can include a power source, such as a battery.

Some embodiments include a sensor that is a temperature sensor. A temperature sensor can include, for example, a mechanical temperature sensor. A temperature sensor can include, for example, an electronic temperature sensor. By way of example, some embodiments include a sensor that is a temperature sensor including one or more of: a thermocouple, a bimetallic temperature sensor, an infrared thermometer, a resistance thermometer, or a silicon bandgap temperature sensor.

Some embodiments include a sensor that is a gas pressure sensor. A gas pressure sensor can include, for example, a mechanical gas pressure sensor, such as a Bourdon tube. A gas pressure sensor can include an expansion valve with a capillary tube. A gas pressure sensor can include, for example, an electronic gas pressure sensor. By way of example, some embodiments include a sensor that is a vacuum sensor. For example, the interior of a vapor conduit can be substantially evacuated, or at a low gas pressure relative to atmospheric pressure, before use of a container and then the vacuum reduced during evaporation from the evaporative liquid. Data from a vacuum sensor can, therefore, be indicative of the rate of evaporation, or the total level of evaporation of the evaporative liquid within the container. In some embodiments, a gas pressure sensor can include a piezoresistive strain gauge, a capacitive gas pressure sensor, or an electromagnetic gas pressure sensor. In some embodiments, a pressure sensor includes a capacitance pressure sensor.

Figure 7:
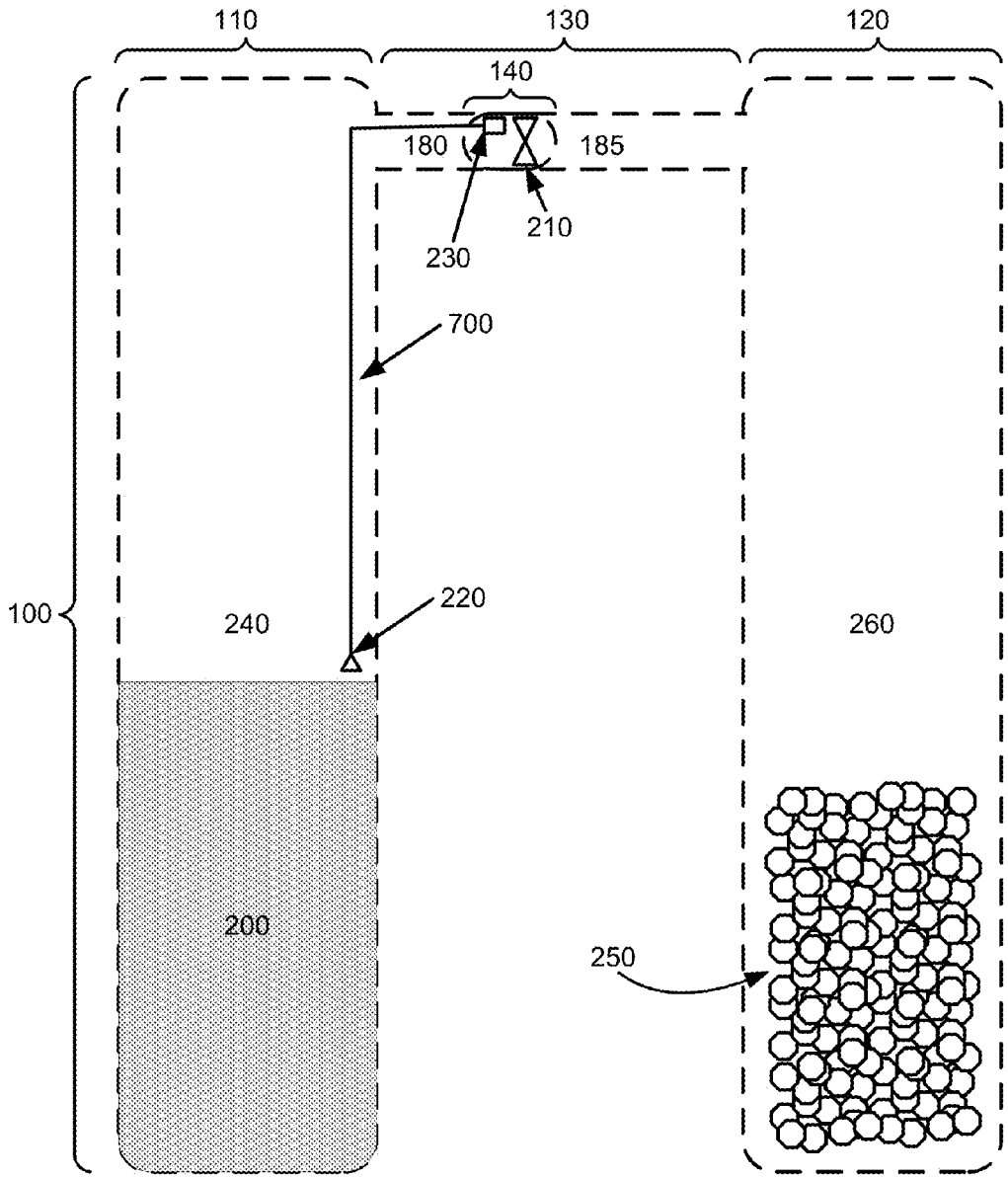
FIG. 7 illustrates, from a cross-section view, aspects of a portable cooling unit configured for use with a storage container.
Figure 8:
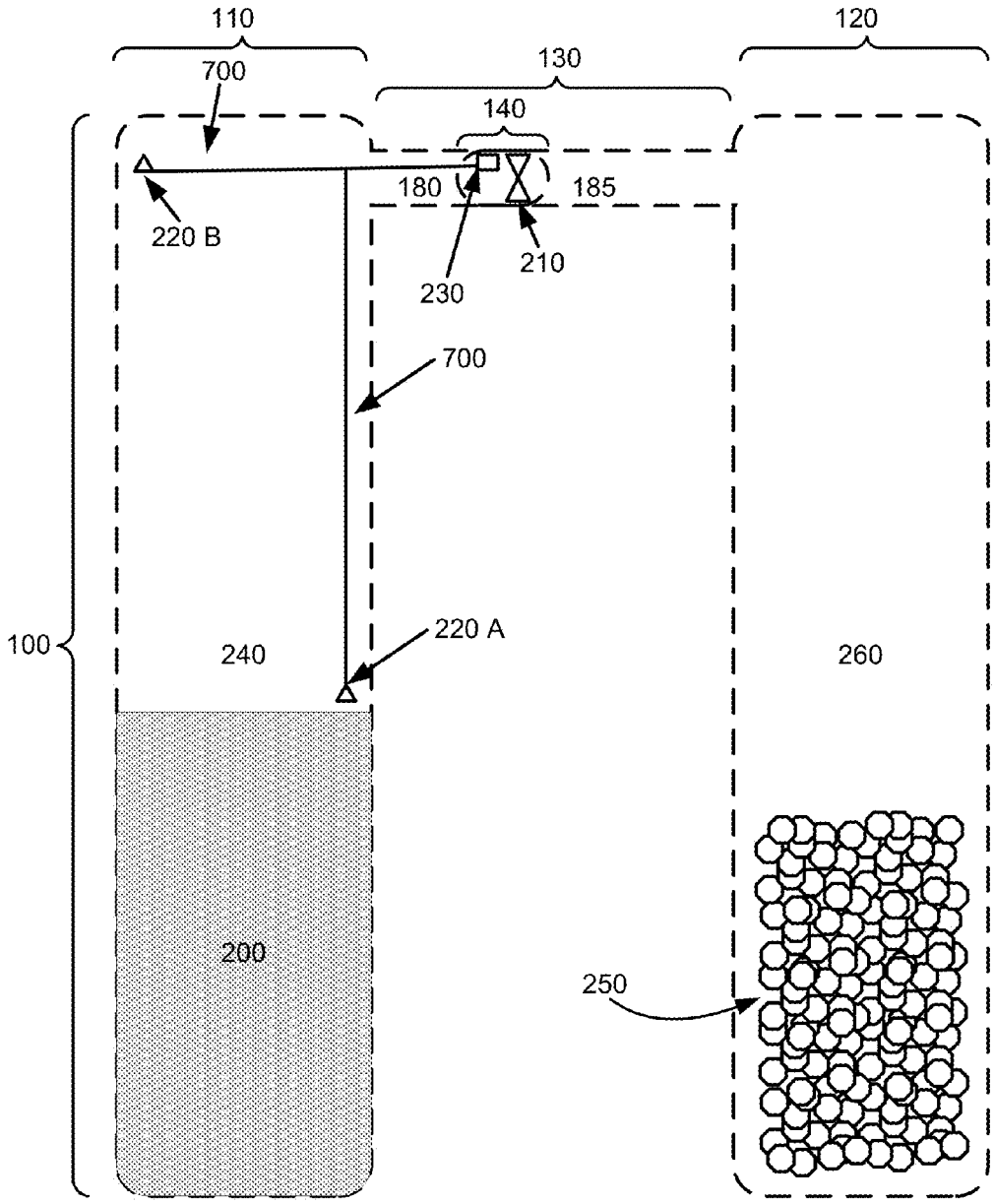
FIG. 8 depicts, from a cross-section view, aspects of a portable cooling unit configured for use with a storage container.

A sensor 220 can transmit data to controller 230 that is an electronic controller via a wire (see, e.g. FIGS. 7 and 8). However, depending on the embodiment, different types of connections between the controller 230, a sensor 220 and a valve 210 are possible. For example, in some embodiments, a sensor includes a thermocouple configured to put physical pressure on a mechanical controller that transmits that physical pressure to a control element of a valve to result in the opening or closing of the valve. For example, in some embodiments, a sensor includes an electronic temperature sensor that sends data regarding detected temperature over time to an electronic controller via a wire or wireless connection, such as through an IR or short wavelength radio transmission (e.g. Bluetooth).

In embodiments including an electronic controller, the electronic controller receives data from one or more sensors, and determines if the detected values are outside or inside of a predetermined range. Depending on the determination, the electronic controller can initiate the valve to open or close to return the temperature or pressure to the predetermined range of values. For example, in some embodiments, if the electronic temperature sensor sends a signal including temperature data at 9 degrees Centigrade, the controller will determine that the received temperature data is outside of the predetermined range of 3 degrees Centigrade to 7 degrees Centigrade. In response to the determination, the controller will send a signal to a motor attached to a valve within the vapor control unit, the signal of a type to initiate the motor to open the valve. As another example, in some embodiments, if the electronic temperature sensor sends a signal including temperature data at 1 degree Centigrade, the controller will determine that the received temperature data is outside of the predetermined range of 3 degrees Centigrade to 7 degrees Centigrade. In response to the determination, the controller will send a signal to a motor attached to a valve within the vapor control unit, the signal of a type to initiate the motor to close the valve.

An electronic temperature sensor can send data at a plurality of data points. In some embodiments, an electronic controller can accept a plurality of temperature data points from one or more temperature sensor, and calculate a temperature result, such as an average temperature, or a mean temperature, from the accepted data. The electronic controller can then determine if the temperature result is outside or inside of a predetermined temperature range. For example, in some embodiments, a predetermined temperature range is between 0 degrees and 10 degrees Centigrade. For example, in some embodiments, a predetermined temperature range is between 2 degrees and 8 degrees Centigrade. For example, in some embodiments, a predetermined temperature range is between 0 degrees and 5 degrees Centigrade. For example, in some embodiments, a predetermined temperature range is between 5 degrees and 15 degrees Centigrade. For example, in some embodiments, a predetermined temperature range is between 5 degrees and −5 degrees Centigrade. For example, in some embodiments, a predetermined temperature range is between −15 degrees and −25 degrees Centigrade. For example, in some embodiments, a predetermined temperature range is between −25 degrees and −35 degrees Centigrade.

In some embodiments, an electronic controller can accept a plurality of gas pressure data points from one or more gas pressure sensors, and calculate a gas pressure result, such as an average gas pressure, or a mean gas pressure, from the accepted data. The electronic controller can then determine if the gas pressure result is outside or inside of a predetermined gas pressure range for the specific portable cooling unit. For example, gas pressure out of a specific, predetermined range can indicate an excess of evaporation of the evaporative liquid, resulting in excess evaporative cooling for the specific portable cooling unit. For example, gas pressure out of a specific, predetermined range can indicate a lack of absorption or adsorption by the desiccant material, indicating that the desiccant material needs to be refreshed or renewed. The gas pressure range is relative to the internal dimensions of the evaporative cooling unit, the conduits, the vapor control unit and the desiccant unit for an embodiment. The gas pressure range is also relative to the type of evaporative liquid, the type of desiccant material, and the predetermined temperature range for cooling in an embodiment. See: Dawoud and Aristov, "Experimental Study on the Kinetics of Water Vapor Sorption on Selective Water Sorbents, Silica Gel and Alumina Under Typical Operating Conditions of Sorption Heat Pumps," *International Journal of Heat and Mass Transfer,* 46: 273-281 (2004); Marquardt, "Introduction to the Principles of Vacuum Physics," CERN Accelerator School, (1999); Kozubal et al., "Desiccant Enhanced Evaporative Air-Conditioning (DEVap): Evaluation of a New Concept in Ultra Efficient Air Conditioning," NREL Technical Report NREL/TP-5500-49722 (January 2011); Conde-Petit, "Aqueous Solutions of Lithium and Calcium Chlorides: —Property Formulations for Use in Air Conditioning Equipment Design," *M. Conde Engineering*, (2009); "Zeolite/Water Refrigerators," BINE Informationsdienst, projektinfo 16/10; "Calcium Chloride Handbook: A Guide to Properties, Forms, Storage and Handling," Dow Chemical Company, (August, 2003); "Introduction of Zeolite Technology into Refrigeration Systems: Layman's Report," Dometic project LIFE04 ENV/LU/000829; Rezk and Al-Dadah, "Physical and Operating Conditions Effects on Silica Gel/Water Adsorption Chiller Performance," *Applied Energy* 89: 142-149 (2012); Saha et al., "A New Generation Cooling Device Employing $CaCl_2$-in-silica Gel-water System," International Journal of Heat and Mass Transfer 52: 516-524 (2009); "An Introduction to Zeolite Molecular Sieves," UOP Company Brochure 0702 A 2.5; and "Vacuum and Pressure Systems Handbook," Gast Manufacturing, Inc., which are each incorporated by reference. An equation to calculate the pressure loss in vacuum lines with water vapor is available from GEA Wiegand, a copy accessed at the company website (http://produkte.gea-wiegand.de/GEA/GEACategory/139/index_en.html) on Mar. 13, 2013 is incorporated herein by reference.

In some embodiments, the vapor control unit 140 includes a visible indicator of information from the controller on the outside of the vapor control unit 140. For example, in some embodiments the vapor control unit 140 includes on its exterior a dial connected to the controller, the dial configured to indicate the temperature reading from the sensor. For example, in some embodiments the vapor control unit 140 includes on its exterior a light connected to the controller, wherein the controller turns the light on and off in combination with sending a control signal to the valve within the vapor control unit 140. For example, in some embodiments the vapor control unit 140 includes on its exterior a light connected to the controller, wherein the controller turns the light on and off in response to data from a pressure sensor attached to the controller. For example, the controller can include circuitry that initiates the light to turn on when information from the pressure sensor indicates that the pressure inside the evaporative cooling system is within a preset range (e.g. to indicate to a user that the internal gas pressure is within a preset acceptable operating range, and therefore is operational, or to indicate to a user that the internal gas pressure is outside of the preset acceptable operating range, and therefore requires maintenance).

Some embodiments include a display unit operably attached to the vapor conduit 130, such as directly to a sensor 220 within the vapor conduit 130. A display unit can include, for example, a light, a screen display, an e-ink display or a similar device. Some embodiments include a display unit operably attached to the control unit. The display unit can, for example, be operably connected to the controller and configured to receive signals from the controller indicating conditions regarding the interior of the portable cooling unit 100. For example, in embodiments including a light as a display unit, the controller can be configured to make a transmission to the light initiating the light to switch on when data accepted from the temperature sensor indicates that the interior temperature of the portable cooling unit 100 is within a preset temperature range. For example, in embodiments including a screen display, the controller can be configured to transmit data regarding the conditions of the portable cooling unit 100 to the screen display, such as the most recent internal temperature reading(s), or the position of the valve. Some embodiments include a user input device, such as a push-button, a touch sensor, or a keypad. The user input device can be operably attached to the controller. For example, the controller may be configured to respond to a specific user input, as transmitted by a user input device, by opening the valve within the vapor conduit. For example, the controller may be configured to respond to a specific user input, as transmitted by a user input device, by initiating a display of the most recent temperature data on an attached screen display.

Figure 3:
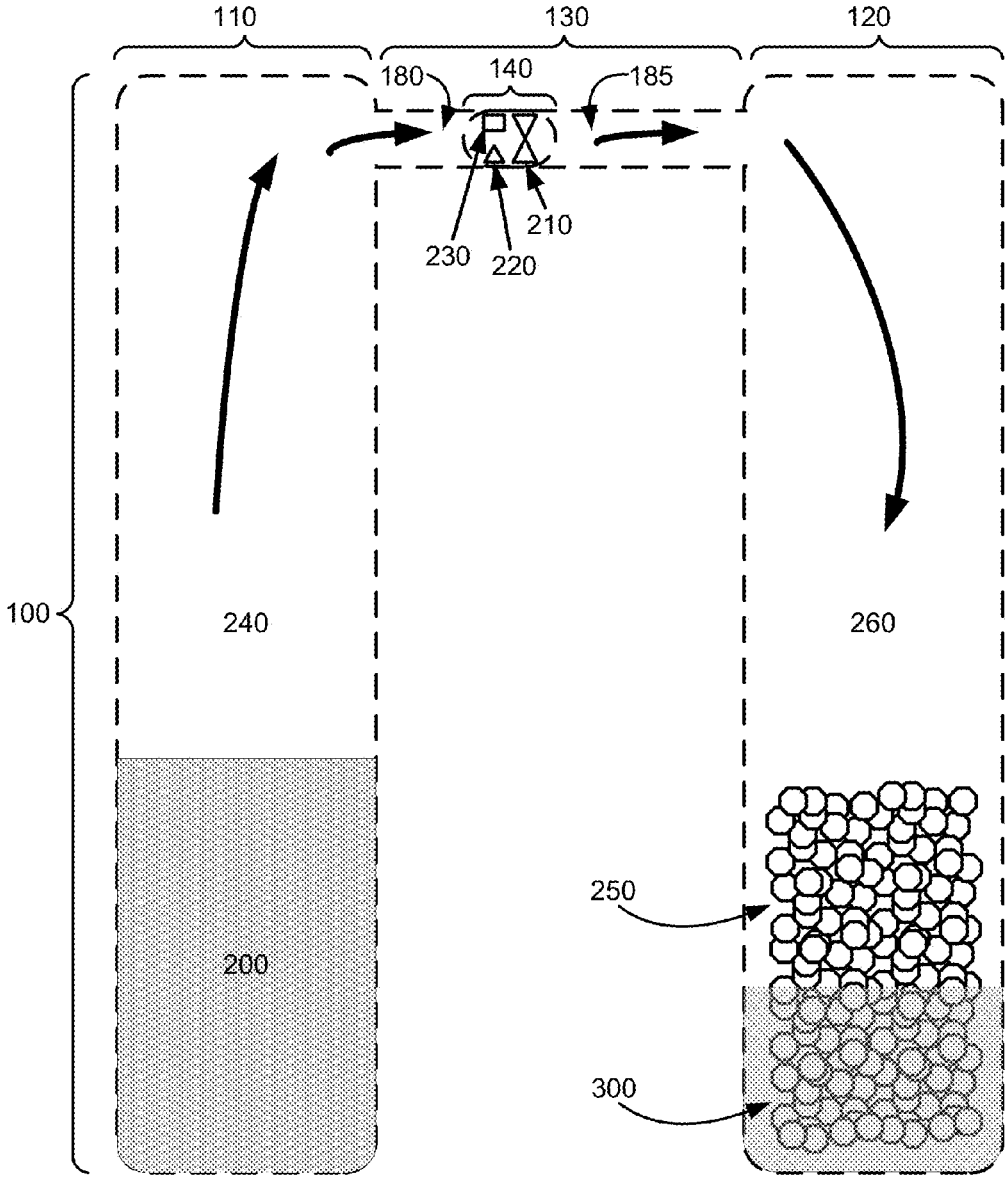
FIG. 3 illustrates, from a cross-section view, aspects of a portable cooling unit configured for use with a storage container.

FIG. 3 illustrates aspects of the interior of a portable cooling unit 100 during use. The illustrated aspects may or may not be visible in a particular embodiment. For example, in some embodiments the evaporative unit 110 and the desiccant unit 120 are fabricated from an opaque material, such as a metal, and the interior is not visible during use. However, in some embodiments one or more sections of the portable cooling unit 100 are fabricated from a transparent or translucent material, such as polycarbonate plastic, and the interior is at least partially visible during use.

During fabrication of the portable cooling unit 100, the gas-sealed, contiguous space within the evaporative unit 110 and the desiccant unit 120 and the vapor conduit 130 are evacuated, for example with a vacuum pump. After a predetermined gas pressure, which is lower than atmospheric pressure, is achieved within the interior of the portable cooling unit 100, the combined spaces are sealed to form a gas-impermeable combined interior space. For example, in some embodiments the combined interior spaces are reduced to a gas pressure of no more than 20 Torr. For example, in some embodiments the combined interior spaces are reduced to a gas pressure of no more than 10 Torr. For example, in some embodiments the combined interior spaces are reduced to a gas pressure of no more than 5 Torr. For example, in some embodiments the combined interior spaces are reduced to a gas pressure of no more than 1 Torr. The gas-sealed, contiguous space within the evaporative unit 110 and the desiccant unit 120 and the vapor conduit 130, therefore, form an internal region of reduced gas pressure within the portable cooling unit 100. Due to the design of the portable cooling unit 100, the gas that is present within this internal region can flow freely between the interior evaporative region 240 of the evaporative unit 110 and the interior desiccant region 260 of the desiccant unit 120 when the valve 210 is in a fully open configuration. During storage of the portable cooling unit 100, such as prior to use or between uses, the valve 210 is retained in a fully closed position, blocking the free flow of gas within the interior regions of the portable cooling unit 100.

FIG. 3 illustrates the interior of the portable cooling unit 100 during use. During use of the portable cooling unit 100, the liquid 200 will evaporate at a rate relative to the temperature of the liquid 200 and the vapor pressure of the liquid 200 within the internal evaporative region 240. The rate of evaporation for any specific liquid at a specific time will occur relative to the temperature of the liquid at the time as well as the physical properties of that specific liquid. For example, at 10 degrees Centigrade, the vapor pressure of water, based on its physical properties, is approximately 9 Torr. Therefore, when the temperature of the liquid 200 within the container is 10 degrees Centigrade, the liquid will tend to evaporate as long as the vapor pressure within the internal evaporative region 240 is less than approximately 9 Torr. As an additional example, the vapor pressure of water, based on its physical properties, is approximately 6.8 torr at 5 degrees Centigrade. Therefore, when the temperature of the liquid 200 within the container is 5 degrees Centigrade, the liquid will tend to evaporate as long as the vapor pressure within the internal evaporative region 240 is less than approximately 6.8 Torr. For any given embodiment, the evaporation temperatures of the included liquid at different internal vapor pressures can be calculated using standard equations and the physical properties of the included liquid. Furthermore, as the vapor pressure of the specific liquid utilized in an embodiment rises within the internal evaporative region 240, the evaporation rate and associated evaporative cooling will diminish. See, e.g. Rezk et al., "Physical and Operating Conditions Effects on Silica Gel/water Adsorption Chiller Performance," *Applied Energy* 89: 142-149 (2012), which is incorporated by reference herein. This can be utilized to create an expected lower cooling temperature boundary for a particular embodiment.

During use of the portable cooling unit 100, evaporation will cool the liquid 200 and the space of the internal evaporative region 240 through the physical effect of evaporative cooling. See: Wang et al., "Study of a Novel Silica Gel-Water Adsorption Chiller. Part I. Design and Performance Prediction," *International Journal of Refrigeration* 28: 1073-1083 (2005); U.S. Pat. No. 6,584,797 "Temperature-Controlled Shipping Container and Method for Using Same," to Smith and Roderick; U.S. Pat. No. 6,688,132 "Cooling Device and Temperature-Controlled Shipping Container Using Same," to Smith et al.; U.S. Pat. No. 6,701,724 "Sorption Cooling Devices," to Smith et al.; and U.S. Pat. No. 6,438,992 "Evacuated Sorbent Assembly and Cooling Device Incorporating Same," to Smith et al., which are each incorporated by reference herein. See also: "Cool-System Presents: CoolKeg® The World's First Self-chilling Keg!" by Coolsystem Company; Sketch of Larry D. Hall's Homemade Icyball; "Icyball is Practical Refrigerator for Farm or Camp Use," advertisement; and the entry labeled "Steam Jet Cycle" from www.machine-history.com, which are each incorporated by reference. When the liquid 200 is at a lower temperature than the adjacent region, heat from the adjacent region will equilibrate through conduction through the outer wall of the evaporative cooling unit 110 to the liquid 200, thereby cooling the adjacent region. It is intended that the external region adjacent to the outer wall of the evaporative cooling unit 110 will be within a storage region of a storage container during use of the portable cooling unit (see, e.g. FIG. 4). Since the interior of the portable cooling unit 100 includes a contiguous, gas-sealed space when the valve 210 is in a fully open position, the vapor phase of the evaporated liquid will disperse throughout the combined spaces (e.g. as the large arrows depicted in FIG. 3). When the vapor phase of the evaporated liquid comes into contact with the desiccant material 250 in the desiccant unit 120, some of the liquid vapor will be removed from the gas phase and become associated with the desiccant material 250 until the desiccant material 250 is saturated with the liquid 300. The removal of liquid vapor in the interior desiccant region 260 of the desiccant unit 120 will reduce the partial pressure of the vapor phase of the liquid 200 within the entirety of the interior desiccant region 260, the interior of the vapor conduit 130 and the interior evaporative region 240 of the evaporative unit 110, as long as the valve 210 is in a fully open position. A reduced vapor pressure will create further evaporative cooling within the interior evaporative region 240 of the evaporative unit 110. Control of the movement of the vapor phase of the liquid 200 through the valve 210 controls the amount of the vapor phase of the liquid 200 present within the interior desiccant region 260 of the desiccant unit 120, and the associated reduction of partial pressure of the vapor phase of the liquid 200 within the internal evaporative region 240. By closing and opening the valve 210 in response to information from the sensor 220, the controller 230 can act to control the rate of evaporation of the liquid 200 and the associated evaporative cooling of the internal evaporative region 240.

Different embodiments of an evaporative cooling unit 110 integral to a portable cooling unit 100 include different types of liquids. In some embodiments, the liquid includes water. In some embodiments, the liquid includes an alcohol, such as methanol or ethanol. A specific liquid is selected based on the evaporation rate of the liquid in the temperature ranges targeted by a specific embodiment, as well as the absorption rate of the vapor phase of the liquid by the desiccant material utilized in the embodiment. In any given embodiment, the evaporation rate of the liquid is promoted by the desiccant material, which removes the liquid vapor from the gas and promotes further evaporation of the liquid, with associated cooling effect. In some embodiments, for example, the liquid includes water, and the desiccant material includes calcium chloride. The liquid evaporation induces a cooling effect on the evaporative cooling unit 110 positioned adjacent to a storage region during use of the portable cooling unit 100. See, e.g. FIG. 4. The evaporation rate is controlled by action of the valve 210, as directed by the controller 230 in response to a sensor 220. For example, if the sensor 220 provides a temperature reading to the controller 230 that is above a predetermined level, the controller 230 can operate to affect an opening of the valve 210. For example, if the sensor 220 provides a temperature reading to the controller 230 that is below a predetermined level, the controller 230 can operate to affect a closure of the valve 210. In some embodiments, the controller 230 only operates to fully open or close the valve 210. In some embodiments, the controller 230 can operate to partially open and/or partially close the valve 210, creating intermediate control of the evaporative cooling by restricting the vapor passage through the valve 210. The ongoing detection of temperature changes combined with control of the valve, and the resulting control of the evaporation rate of the liquid, provides control of the temperature within the internal evaporative region 240 as well as through thermal conduction to a region adjacent to the evaporative unit 110.

Figure 4:
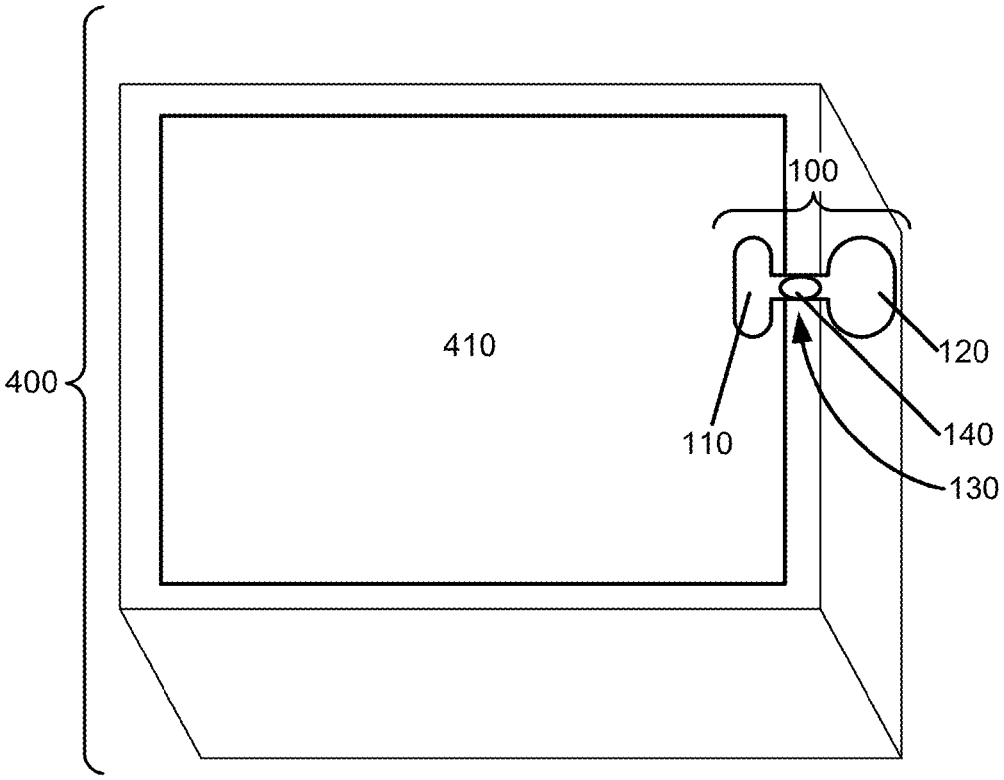
FIG. 4 depicts a portable cooling unit in use with a storage container.

FIG. 4 illustrates aspects of a portable cooling unit 100 in use with a storage container 400. For example, the storage container 400 can include a storage box fabricated from a low thermal conduction material, such as solid plastic foam. In some embodiments, the storage container 400 includes a plastic shell or casing. In some embodiments, the storage container 400 includes layers of heavy paper or cardboard. Although the storage container 400 depicted in FIG. 4 is substantially rectangular, different embodiments of a portable cooling unit 100 can be configured for use with a storage container 400 of different shapes and sizes. The storage container 400 includes an interior storage region 410, configured for storage of material in a specific temperature range. For example, the storage container 400 can include an interior storage region 410 configured for storage of material in a temperature range between 0 degrees Centigrade and 10 degrees Centigrade. For example, the storage container 400 can include an interior storage region 410 configured for storage of material in a temperature range between 2 degrees Centigrade and 2 degrees Centigrade. For example, the storage container 400 can include an interior storage region 410 configured for storage of material in a temperature range between 5 degrees Centigrade and −5 degrees Centigrade. For example, the storage container 400 can include an interior storage region 410 configured for storage of material in a temperature range between −5 degrees Centigrade and −15 degrees Centigrade. For example, the storage container 400 can include an interior storage region 410 configured for storage of material in a temperature range between −15 degrees Centigrade and −20 degrees Centigrade.

FIG. 4 shows a portable cooling unit 100 positioned on the storage container 400 so that the evaporative cooling unit 110 is within the interior storage region 410 and the desiccant unit 120 is positioned exterior to the storage container 400. The vapor conduit 130 is positioned adjacent to the structure of the storage container 400, such as balanced on a wall of the storage container 400. In an embodiment such as illustrated in FIG. 4, the vapor conduit 130 can be configured to support the portable cooling unit 100 in position on the storage container 400. The desiccant unit 120 is positioned exterior to the storage container 400, and not within the storage region 410. Heat from the desiccant unit 120, can, therefore, be isolated from the storage region 410 during use of the portable cooling unit 100. During use, the evaporative cooling unit 110 can be controllably maintained within a predetermined temperature range by action of the vapor control unit 140 for a period of time, until the liquid and desiccant material are exhausted. For example, in some embodiments the target temperature range of the storage region 410 is between 0 and 10 degrees Centigrade, and the portable cooling unit 100 includes approximately 1 liter of liquid water and a corresponding volume of desiccant material including calcium chloride to absorb greater than 1 liter of water. In such an embodiment, the evaporative cooling unit 110 should be able to be maintained for several hours, and potentially days, depending on the temperature external to the storage container 400 and the thermal properties of the storage container 400. A lid can be positioned over a storage container 400 in some embodiments.

Figure 5:
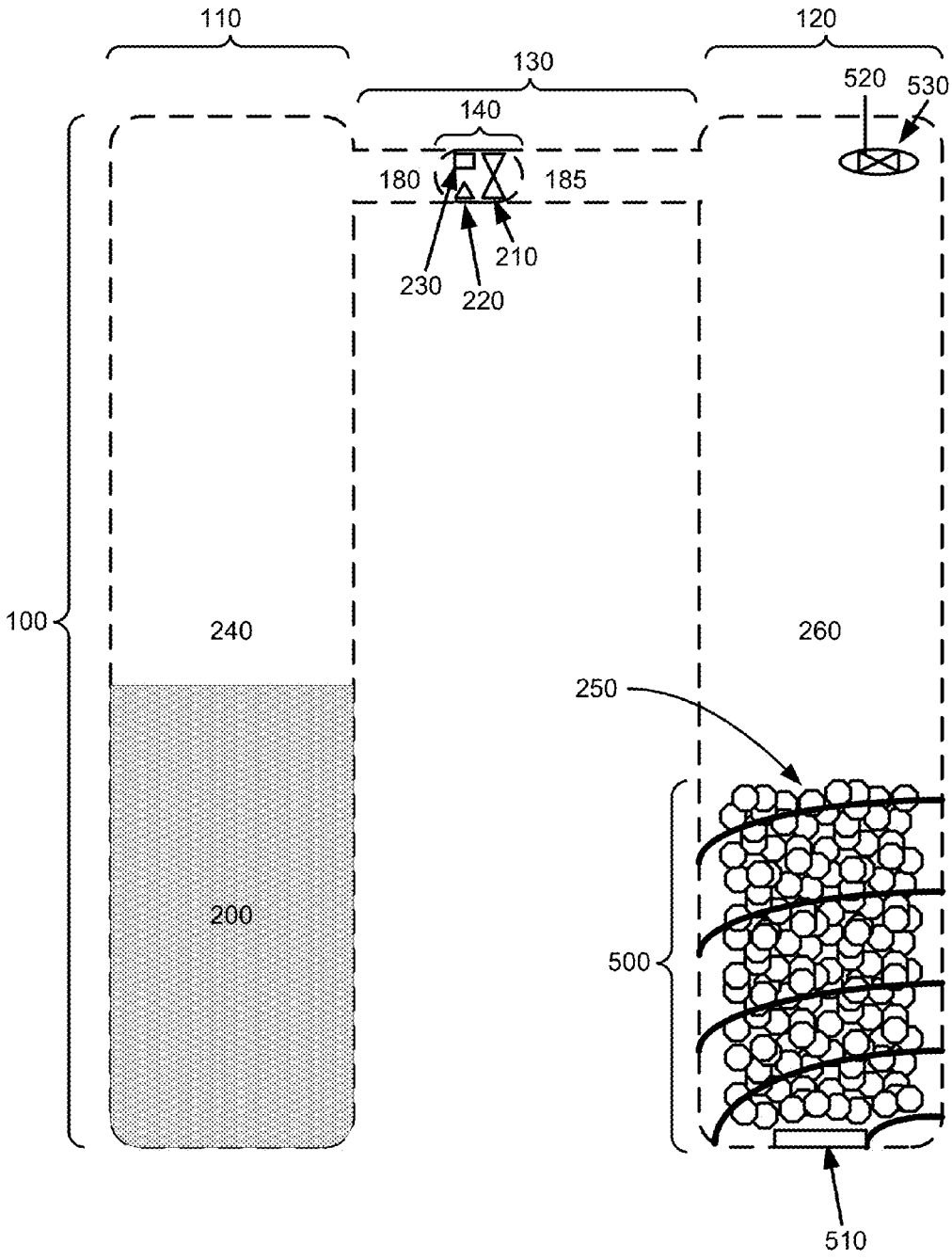
FIG. 5 illustrates, from a cross-section view, aspects of a portable cooling unit configured for use with a storage container.

FIG. 5 illustrates aspects of a portable cooling unit 100. The portable cooling unit 100 is depicted in FIG. 5 in a substantially vertical cross-section view. As shown in FIG. 5, the portable cooling unit 100 includes an evaporative cooling unit 110 and a desiccant unit 120 connected by a vapor conduit 130. The interior evaporative region 240 of the evaporative cooling unit 110 and the interior desiccant region 260 of the desiccant unit 120 form a contiguous space through the interior of the vapor conduit 130. The vapor conduit 130 includes a vapor control unit 140. In the illustrated embodiment, the vapor control unit 140 includes a valve 210 configured to reversibly open and close to reversibly allow and block the free flow of gas through the vapor conduit 130. The valve 210 is also configured to reversibly inhibit the free flow of gas through the vapor conduit 130 by being partially open or closed. The valve 210 is operably connected to a controller 230. The controller 230 is configured to receive temperature information from a sensor 220, and to act to direct the action of the valve 210 based on the received temperature information and a set of predetermined parameters.

As shown in FIG. 5, the desiccant unit 120 includes desiccant material 250. The desiccant unit 120 also includes a heating element 500 positioned adjacent to the desiccant material 250. In the embodiment illustrated in FIG. 5, the desiccant unit 120 includes a heating element 500 within the desiccant unit 120, the heating element 500 configured to heat the interior desiccant region 260. The heating element 500 can be positioned adjacent to an interior surface of the interior desiccant region 260. For example, the heating element 500 can include an electrical heating coil positioned around the interior of the desiccant unit 120 and in thermal contact with the desiccant material 250. In some embodiments, the heating element is positioned external to the desiccant unit 120, for example adjacent to the external wall of the desiccant unit 120. For example, the heating element can include a heat lamp positioned adjacent to the exterior surface of the desiccant unit 120. The heating element 500 can be utilized to recharge or refresh the portable cooling unit 100 between uses. For example, the heating element 500 can be utilized to warm the desiccant material 250 sufficiently to release the associated liquid, which can then flow via vapor and gas flow through the vapor conduit 130 back to the interior evaporative region 240 of the evaporative cooling unit 110, where it can re-condense as liquid 200 for future use. Some embodiments include a gas release unit 530, including a valve configured for release of excess gas pressure. For example, the gas release unit can include a one-way valve unit, the one-way valve unit configured for release of gas from the interior desiccant region 260. The gas release unit 530 can be utilized, for example, when the heating unit 500 is warming the interior desiccant region 260, to ensure that excess gas pressure does not build up within the interior desiccant region 260 of the desiccant unit 120.

In some embodiments, the desiccant unit 120 includes a power unit 510. For example, the power unit 510 can include a plug-in to an AC or DC power source. For example, the power unit 510 can include a solar panel positioned to collect solar energy from a region external to the container. For example, the power unit 510 can include a battery. In some embodiments, a battery is rechargeable. In some embodiments, a battery can be removed and replaced. Some embodiments include a power unit 510 operably attached to the heating element 500. For example, the power unit 510 can include one or more of: a battery pack, an electric plug configured to receive AC or DC power from an external source, a solar panel, or a mechanical generator (e.g. a crank mechanism).

Figure 6:
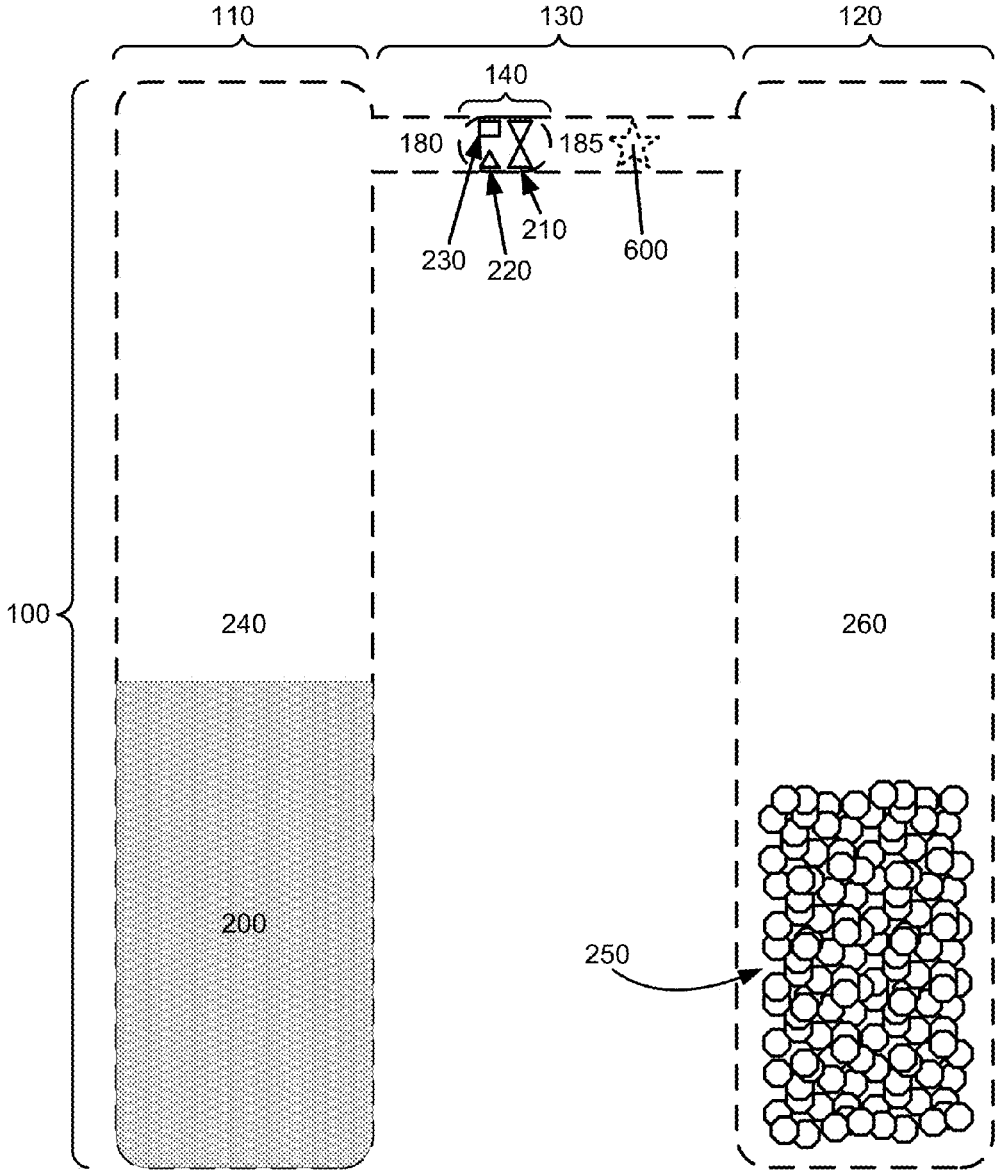
FIG. 6 depicts, from a cross-section view, aspects of a portable cooling unit configured for use with a storage container.

FIG. 6 illustrates aspects of an embodiment of a portable cooling unit 100. The portable cooling unit 100 is shown in substantial cross-section. The portable cooling unit 100 includes an evaporative cooling unit 110, a vapor conduit 130 and a desiccant unit 120. A vapor control unit 140 is attached to the vapor conduit 130. As shown in FIG. 6, the vapor conduit also includes an externally-breakable seal 600 positioned across the internal passageway of the vapor conduit 130, the externally-breakable seal 600 configured to prevent the flow of gas through the internal passageway of the vapor conduit 130. For example, when the portable cooling unit 100 is in storage or transport after fabrication or refreshment, the externally-breakable seal 600 will prevent the flow of gas, including liquid vapor, between the interior evaporative region 240 and the interior desiccant region 260 through the vapor conduit 130. When a user wishes to utilize the portable cooling unit 100, the externally-breakable seal 600 can be broken, thus permitting the evaporative cooling process within the portable cooling unit 100. A externally-breakable seal 600 can be fabricated, for example, from a thin and brittle, as well as gas-impermeable, membrane across the entire interior of the vapor conduit 130 in a specific region. For example, the externally-breakable seal 600 can be fabricated from glass or brittle plastic. Some embodiments include an externally-breakable seal 600 that is externally-breakable by the orientation of the portable cooling unit 100, for example by inverting the portable cooling unit 100. In some embodiments, the externally-breakable seal 600 is magnetic, and is configured to be broken open with the application of a magnetic field from a magnet placed adjacent to the exterior of the vapor conduit 130.

FIG. 7 illustrates additional aspects of some embodiments of a portable cooling unit 100. The portable cooling unit 100 illustrated in FIG. 7 is depicted in cross-section. The portable cooling unit 100 includes an evaporative cooling unit 110, a vapor conduit 130 and a desiccant unit 120. The evaporative cooling unit 110 includes evaporative liquid, 200. The desiccant unit 120 includes desiccant material, 250. A vapor control unit 140 is attached to the vapor conduit 130. The vapor control unit 140 includes a valve 210 and a controller 230 operably connected to the valve. The portable cooling unit 100 includes a sensor 220 positioned within the interior evaporative region 240 of the evaporative cooling unit 110. The sensor 220 is connected to the controller 230 with a wire connection 700.

FIG. 8 shows aspects of an embodiment of a portable cooling unit 100. The portable cooling unit 100 illustrated in FIG. 8 is depicted in cross-section. The portable cooling unit 100 includes an evaporative cooling unit 110, a vapor conduit 130 and a desiccant unit 120. The evaporative cooling unit 110 includes evaporative liquid, 200. The desiccant unit 120 includes desiccant material, 250. A vapor control unit 140 is attached to the vapor conduit 130. The vapor control unit 140 includes a valve 210 and a controller 230 operably connected to the valve. The portable cooling unit 100 also includes two sensors 220 A, 220 B, positioned within the interior evaporative region 240. The two sensors 220 A, 220 B are positioned in different regions of the interior evaporative region 240. Both of the two sensors 220 A, 220 B are connected to the controller 230 with a wire connection 700. Although FIG. 8 depicts two sensors 220 A, 220 B, in some embodiments a portable cooling unit 100 includes more than two sensors. The sensors 220 can be positioned, for example, at different locations within the interior evaporative region 240. The sensors 220 can be positioned, for example, within the vapor conduit 130. The sensors 220 can be positioned, for example, both within the interior evaporative region 240 and within the vapor conduit 130. Some embodiments include sensors positioned within the interior desiccant region 260. Some embodiments include temperature sensors configured to detect a temperature on the exterior of the portable cooling unit 100. Some embodiments include, for example a temperature sensor embedded in the structural wall of the evaporative cooling unit 110 and connected to the controller 230 via a wire connection 700. Some embodiments include, for example a gas pressure sensor embedded in the structural wall of the evaporative cooling unit 110 and connected to the controller 230 via a wire connection 700.

Figure 9:
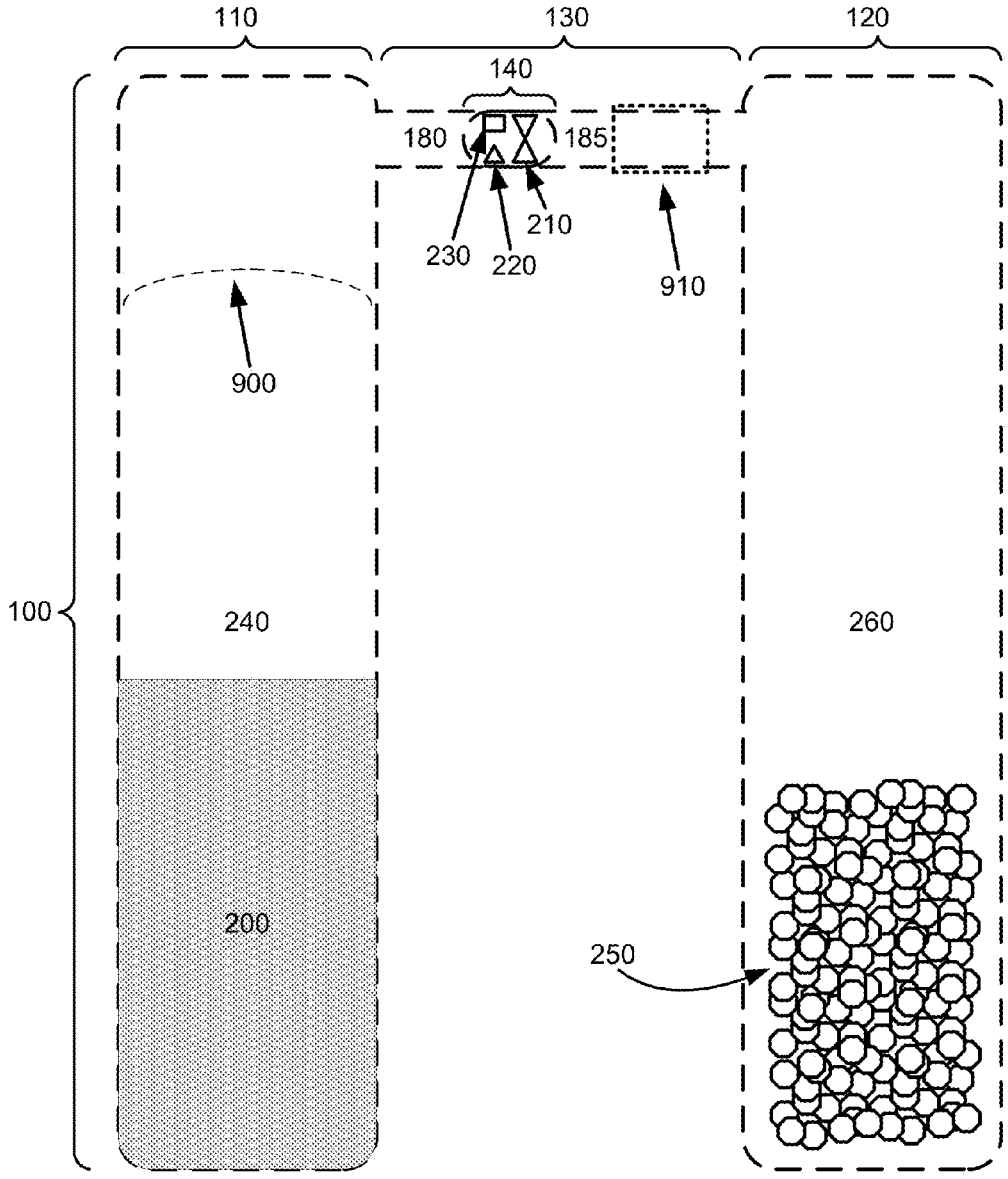
FIG. 9 illustrates, from a cross-section view, aspects of a portable cooling unit configured for use with a storage container.

FIG. 9 depicts aspects of an embodiment of a portable cooling unit 100. The portable cooling unit 100 shown in FIG. 9 is depicted in cross-section. The portable cooling unit 100 includes an evaporative cooling unit 110, a vapor conduit 130 and a desiccant unit 120. The desiccant unit 120 includes desiccant material, 250. The evaporative cooling unit 110 includes evaporative liquid, 200. A vapor control unit 140 is attached to the vapor conduit 130. The vapor control unit 140 includes a valve 210 and a controller 230 operably connected to the valve. The vapor control unit 140 includes a sensor 220 connected to the controller 230.

The portable cooling unit 100 shown in FIG. 9 includes a liquid retaining unit 900. In the embodiment illustrated, the liquid retaining unit 900 is connected to the interior surface of the interior evaporative region 240 of the evaporative cooling unit 110. In some embodiments, a liquid retaining unit 900 is connected to at least one surface adjacent to the interior evaporative region 240 of the evaporative cooling unit 110. A liquid retaining unit 900 is configured to minimize the movement of drops of liquid 200 within the interior evaporative region 240 and into the vapor conduit 130 during transport or movement of the portable cooling unit 100. For example, the liquid retaining unit 900 can include a mesh or screen with apertures of a suitable size to substantially inhibit drops of the liquid 200 from passing through. The liquid retaining unit 900 should permit free flow of gas and liquid vapor through the liquid retaining unit 900, while inhibiting drops of liquid 200.

FIG. 9 also depicts a collapsible region 910 of the vapor conduit 130. In some embodiments, a vapor conduit 130 of a portable cooling unit 100 includes a collapsible region 910. The collapsible region 910 is configured from reversibly-collapsible material, such as a pliable plastic material. The vapor conduit 130 can be reversibly bent or twisted at the collapsible region 910 in order to prevent the flow of gas, including liquid vapor, through the vapor conduit 130. The lack of free flow of gas, including liquid vapor, through the vapor conduit 130 will inhibit the evaporative cooling effect within the interior evaporative region 240 by increasing the vapor pressure of the liquid within the interior evaporative region 240. During storage or transport of the portable cooling unit 100, the vapor conduit 130 can be reversibly bent or twisted at the collapsible region 910 to maintain the maximum evaporative cooling potential of the liquid 200 and desiccant material 250 during actual use of the portable cooling unit 100.

In some embodiments, a portable cooling unit includes at least one layer of nontoxic material on an exterior surface. For example, a portable cooling unit can include nontoxic material on an external surface of an evaporative cooling unit, configured for positioning within a storage container. Nontoxic material can include, for example, material that does not produce residue that can be toxic to the contents of a storage container, or material that does not produce residue that can be toxic to the future users of contents of a storage container. Nontoxic material can include material that maintains the chemical structure of the contents of the storage container, for example nontoxic material can include chemically inert or non-reactive materials. Nontoxic material can include material that has been developed for use in, for example, medical, pharmaceutical or food storage applications. Nontoxic material can include material that can be cleaned or sterilized, for example material that can be irradiated, autoclaved, or disinfected. Nontoxic material can include material that contains one or more antibacterial, antiviral, antimicrobial, or antipathogen agents. For example, nontoxic material can include aldehydes, hypochlorites, oxidizing agents, phenolics, quaternary ammonium compounds, or silver. Nontoxic material can include material that is structurally stable in the presence of one or more cleaning or sterilizing compounds or radiation, such as plastic that retains its structural integrity after irradiation, or metal that does not oxidize in the presence of one or more cleaning or sterilizing compounds. Nontoxic material can include material that consists of multiple layers, with layers removable for cleaning or sterilization, such as for reuse of the at least one substantially thermally sealed storage region. Nontoxic material can include, for example, material including metals, fabrics, papers or plastics.

In some embodiments, a portable cooling unit includes at least one layer including at least one metal on an exterior surface. For example, the at least one metal can include gold, aluminum, copper, or silver. The at least one metal can include at least one metal composite or alloy, for example steel, stainless steel, metal matrix composites, gold alloy, aluminum alloy, copper alloy, or silver alloy. In some embodiments, the at least one metal includes metal foil, such as titanium foil, aluminum foil, silver foil, or gold foil. A metal foil can be a component of a composite, such as, for example, in association with polyester film, such as polyethylene terephthalate (PET) polyester film. The at least one layer including at least one metal on an exterior surface of a portable cooling unit can include at least one metal that can be sterilizable or disinfected. For example, the at least one metal can be sterilizable or disinfected using plasmons. For example, the at least one metal can be sterilizable or disinfected using autoclaving, thermal means, or chemical means. Depending on the embodiment, the at least one layer including at least one metal on the exterior surface of a portable cooling unit can include at least one metal that has specific heat transfer properties, such as thermal radiative properties.

Some embodiments can include a portable cooling unit including one or more external temperature sensors on an external surface. For example, at least one external temperature sensor can be located exterior to the portable cooling unit on the evaporative cooling unit or the desiccant unit. In some embodiments, multiple external temperature sensors can be located in multiple external positions. External temperature sensors can include temperature indicating labels, which can be reversible or irreversible. See, for example, the Environmental Indicators sold by ShockWatch Company, with headquarters in Dallas Tex., the Temperature Indicators sold by Cole-Palmer Company of Vernon Hills Ill. and the Time Temperature Indicators sold by 3M Company, with corporate headquarters in St. Paul Minn., the brochures for which are each hereby incorporated by reference. External temperature sensors can include time-temperature indicators, such as those described in U.S. Pat. Nos. 5,709,472 and 6,042,264 to Prusik et al., titled "Time-temperature indicator device and method of manufacture" and U.S. Pat. No. 4,057,029 to Seiter, titled "Time-temperature indicator," which are each herein incorporated by reference. External temperature sensors can include, for example, chemically-based indicators, temperature gauges, thermometers, bimetallic strips, or thermocouples.

In some embodiments, a portable cooling unit can include one or more sensors. In some embodiments, multiple sensors can be located in multiple positions. In some embodiments, the one or more sensors includes at least one sensor of a gaseous pressure within an interior evaporative region, or sensor of gaseous pressure within an interior desiccant region. In some embodiments, at least one sensor can include a temperature sensor, such as, for example, chemical sensors, thermometers, bimetallic strips, or thermocouples. A portable cooling unit can include one or more sensors such as a pressure sensor such as described in U.S. Pat. No. 5,900,554 to Baba et al., titled "Pressure sensor," which is herein incorporated by reference. A portable cooling unit can include one or more sensors such as a vertically integrated sensor structure such as described in U.S. Pat. No. 5,600,071 to Sooriakumar et al., titled "Vertically integrated sensor structure and method," which is herein incorporated by reference. A portable cooling unit can include one or more sensors of radio frequency identification ("RFID") tags to identify material within a storage container. RFID tags are well known in the art, for example in U.S. Pat. No. 5,444,223 to Blama, titled "Radio frequency identification tag and method," which is herein incorporated by reference.

In some embodiments, a portable cooling unit can include one or more communications devices. The one or more communications devices, can include, for example, one or more recording devices, one or more transmission devices, one or more display devices, or one or more receivers. Communications devices can include, for example, communication devices that allow a user to detect information about the portable cooling unit visually, auditorily, or via signal to a remote device. Some embodiments can include communications devices on the exterior of the portable cooling unit, including devices attached to the exterior of the portable cooling unit, devices adjacent to the exterior of the portable cooling unit, or devices located at a distance from the exterior of the portable cooling unit. Some embodiments can include communications devices located within the structure of the portable cooling unit. Some embodiments can include, for example, communications devices located within the vapor conduit. Some embodiments can include at least one display device located at a distance from the portable cooling unit, for example a display located at a distance operably linked to at least one sensor. Some embodiments can include more than one type of communications device, and in some embodiments the devices can be operably linked. For example, some embodiments can contain both a receiver and an operably linked transmission device, so that a signal can be received by the receiver which then causes a transmission to be made from the transmission device. Some embodiments can include more than one type of communications device that are not operably linked. For example, some embodiments can include a transmission device and a display device, wherein the transmission device is not linked to the display device.

In some embodiments a portable cooling unit can include one or more recording devices. The one or more recording devices can include devices that are magnetic, electronic, chemical, or transcription based recording devices. One or more recording device can be located within the portable cooling unit, one or more recording device can be located exterior to the portable cooling unit, or one or more recording device can be located within the structure of the portable cooling unit. The one or more recording device can record, for example, the temperature from one or more temperature sensor, or the gaseous pressure, mass, volume or identity of an item information from at least one sensor attached to the portable cooling unit. In some embodiments, the one or more recording devices can be integrated with one or more sensor. For example, in some embodiments there can be one or more temperature sensors which record the highest, lowest or average temperature detected. For example, in some embodiments, there can be one or more mass sensors which record one or more mass changes within the container over time. For example, a mass sensor can record the loss of mass within the interior evaporative region of a evaporative cooling unit, and/or the gain of mass within the interior desiccant region of a desiccant unit. For example, in some embodiments, there can be one or more gaseous pressure sensors which record one or more gaseous pressure changes within the portable cooling unit over time.

In some embodiments a portable cooling unit can include one or more transmission device. One or more transmission device can be located within the portable cooling unit, one or more transmission device can be located exterior to the portable cooling unit, or one or more transmission device can be located within the structure of the portable cooling unit. The one or more transmission device can transmit any signal or information, for example, the temperature from one or more temperature sensor, or the gaseous pressure, mass, volume or identity of an item or information from at least one sensor attached to the portable cooling unit. In some embodiments, the one or more transmission device can be integrated with one or more sensor, or one or more recording device. The one or more transmission devices can transmit by any means known in the art, for example, but not limited to, via radio frequency (e.g. RFID tags), magnetic field, electromagnetic radiation, electromagnetic waves, sonic waves, or radioactivity.

In some embodiments, a portable cooling unit can include one or more receivers. For example, one or more receivers can include devices that detect sonic waves, electromagnetic waves, radio signals, electrical signals, magnetic pulses, or radioactivity. Depending on the embodiment, one or more receiver can be located within an interior region of the portable cooling unit, for example within a vapor control unit. In some embodiments, one or more receivers can be located within the structure of the portable cooling unit. In some embodiments, the one or more receivers can be located on the exterior of the portable cooling unit. In some embodiments, the one or more receiver can be operably coupled to another device, such as for example one or more display devices, recording devices or transmission devices. For example, a receiver can be operably coupled to a display device on the exterior of the portable cooling unit so that when an appropriate signal is received, the display device indicates data, such as time or temperature data. For example, a receiver can be operable coupled to a transmission device so that when an appropriate signal is received, the transmission device transmits data, such as location, time, or positional data.

Figure 10:
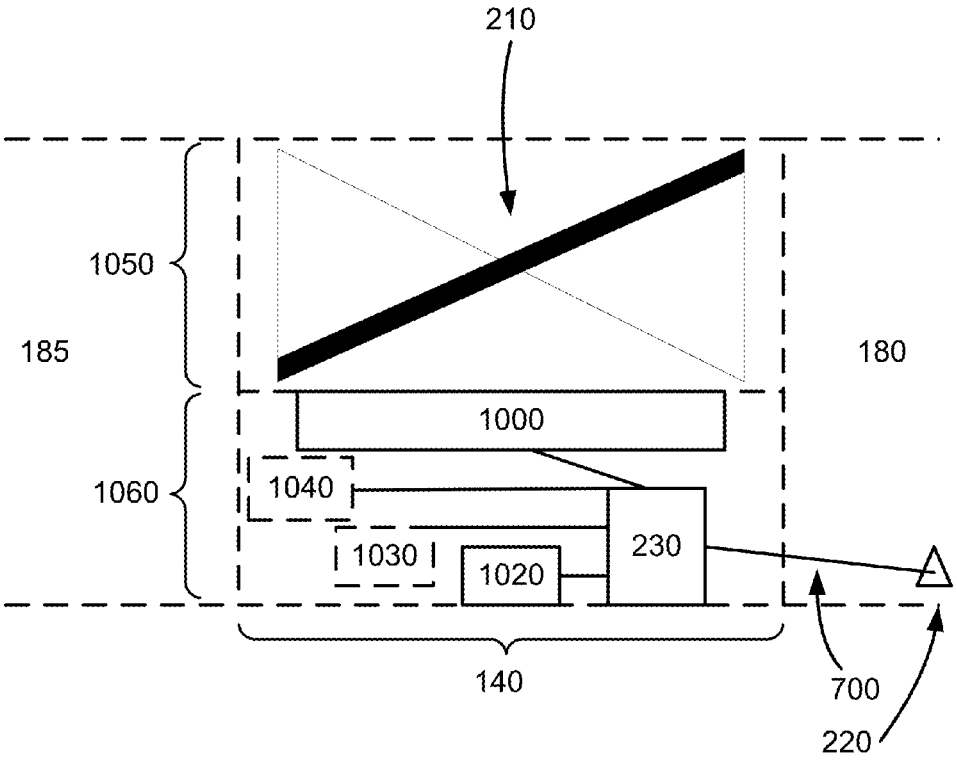
FIG. 10 depicts aspects of a vapor control unit.

FIG. 10 illustrates aspects of an embodiment of a vapor control unit 140. The vapor control unit 140 shown in FIG. 10 is positioned at the junction between a first end 185 of a vapor conduit 130 and a second end 180 of a vapor conduit 130. FIG. 10 illustrates a vapor control unit 140 within the interior dimensions of the vapor conduit 130. In some embodiments, a vapor control unit is entirely internal to the vapor conduit. In some embodiments, a vapor control unit includes one or more components that are external to the vapor conduit. The vapor control unit 140 includes a valve region 1050 and a control region 1060.

The valve region 1050 of the vapor control unit 140 illustrated in FIG. 10 includes a valve 210. In the embodiment illustrated, the valve 210 is a butterfly valve, directly physically connected to the control region 1060 of the vapor control unit 140. The valve 210 is positioned and sized to include at least two positions, a substantially open position and a substantially closed position within the valve region 1050. When the valve 210 is in a substantially open position, the dimensions of the valve 210 within the valve region 1050 of the vapor control unit 140 permit free flow of gas, including vapor, between the first end 185 of the vapor conduit and the second end 180 of the vapor conduit to equalize gas pressure between the first end 185 of the vapor conduit and the second end 180 of the vapor conduit. The valve 210 is of a size and shape to substantially block the flow of gas between first end 185 of the vapor conduit and the second end 180 of the vapor conduit when the valve 210 is in a substantially closed position. In some embodiments, a valve 210 includes one or more intermediate positions that partially impede gas flow through the valve 210 between the first end 185 of the vapor conduit and the second end 180 of the vapor conduit, but do not fully block gas flow. For example, a valve 210 can have a "half-flow" position, or a position that reduces the flow of gas through the valve 210, and therefore between the first end 185 of the vapor conduit and the second end 180 of the vapor conduit, by approximately half, relative to the fully open position. For example, a valve 210 can have a "quarter-flow" position, or a position that reduces the flow of gas through the valve 210, and therefore between the first end 185 of the vapor conduit and the second end 180 of the vapor conduit, to approximately one quarter of the gas flow relative to the fully open position.

The valve 210 illustrated in FIG. 10 is directly connected to a motor 1000. For example, in some embodiments the motor 1000 is a servomotor. For example, in some embodiments the motor 1000 is a stepper motor. The motor 1000 is directly connected to the valve 210 and causes the opening and closing of the valve 210 on receipt of signals from the controller 230. The motor 1000 is directly connected to the controller 230 with a wire connector. The controller 230 is an electronic controller. For example, in some embodiments, an electronic controller is a "bang-bang" controller. For example, in some embodiments, an electronic controller is a bounded system controller. For example, in some embodiments, an electronic controller is a threshold system controller. For example, in some embodiments an electronic controller is a feedback system controller. For example, in some embodiments an electronic controller is a PID controller. A sensor 220 is attached to the controller 230 with a wire connector 370 in the embodiment illustrated in FIG. 10.

The controller 230 can include circuitry configured to perform specific operations and processes. For example, the controller can include circuitry configured to accept data from an attached sensor and determine if the data is within a preset range, wherein the controller sends a signal to the motor that results in either opening or closing the valve, relative to if the data is above or below the preset range. For example, in some embodiments a controller includes circuitry that accepts data originating with a temperature sensor, compares that data with a preset range of temperatures, and if the data from the temperature sensor indicates a detected temperature that is above the preset range, the controller sends a signal to the motor to initiate the valve to open. For example, in some embodiments a controller includes circuitry that accepts data originating with a temperature sensor, compares that data with a preset range of temperatures, and if the data from the temperature sensor indicates a detected temperature that is within the preset range, the controller does not send a signal to the motor. For example, in some embodiments a controller includes circuitry that accepts data originating with a temperature sensor, compares that data with a preset range of temperatures, and if the data from the temperature sensor indicates a detected temperature that is below the preset range, the controller sends a signal to the motor to initiate the valve to close. In some embodiments, the preset temperature range is between 2 degrees Centigrade and 8 degrees Centigrade. In some embodiments, the preset temperature range is between 3 degrees Centigrade and 7 degrees Centigrade. In some embodiments, the preset temperature range is between −2 degrees Centigrade and +2 degrees Centigrade. In some embodiments, the preset temperature range is between −3 degrees Centigrade and −7 degrees Centigrade.

In some embodiments, the controller includes circuitry that calculates an error value between data accepted from a sensor and a predetermined target value. The calculation can include data accepted over time, i.e. multiple data points from a single sensor. The calculation can include data accepted from a plurality of sensors. In response to the calculated error values, the controller can calculate a predicted future error value. The circuitry then calculates a combined error value. If the calculated combination of the calculated past, present and future error values is beyond the preset setpoint, the circuitry then initiates a signal to the motor to alter the opening of the valve. For example, a preset setpoint for some embodiments of a vapor control unit is 5 degrees Centigrade. In such an embodiment, if the combination of the calculated past, present and future error values was higher than the preset setpoint (e.g. 8 degrees Centigrade), the controller would send a signal to the motor, the signal of a type to initiate the motor to open the attached valve. Similarly, in such an embodiment, if the combination of the calculated past, present and future error values was lower than the preset setpoint (e.g. 2 degrees Centigrade), the controller would send a signal to the motor, the signal of a type to initiate the motor to close the attached valve.

As shown in FIG. 10, the control region 1060 of the vapor control unit 140 includes a power source 1020. The power source 1020 can include, for example, a battery. The battery can be rechargeable, for example from a AC or DC power source or a mechanical mechanism, such as a crank. The power source can include a solar cell connected to the external surface of the vapor control unit 140. In the embodiment illustrated in FIG. 10, the power source 1020 is connected to the controller 230 with a wire connection. In the embodiment illustrated, the power source 1020 supplies electrical power to the controller 230, which then further transfers electrical power to the motor 1000. The controller 230 can, for example, transfer power to the motor when needed to operate the motor 1000. In some embodiments, the power source 1020 supplies electrical power to the motor 1000 directly, such as through a direct wire connection.

FIG. 10 illustrates that in some embodiments the control region 1060 of the vapor control unit 140 includes optional memory 1030. The memory 1030 can, for example, be non-volatile memory. The memory 1030 can, for example, be integrated into the controller 230, or operably connected to the controller 230. The memory 1030 can, for example, be random-access (RAM) memory.

FIG. 10 illustrates that in some embodiments the control region 1060 of the vapor control unit 140 includes optional transmitter unit 1040. For example, the control region 1060 can include a transmitter unit 1040 including an antenna and circuitry configured to send a signal from the antenna. The circuitry configured to send a signal from the antenna can be responsive to the controller 230, for example the circuitry configured to send a signal from the antenna can send the signal based on data received from the controller 230 (e.g. one or more data points based on data from the sensor, information on activity of the motor 1000, or the result of calculations made by the controller 230). The transmitter unit can be, for example, a Bluetooth™ unit.

Figure 11A:
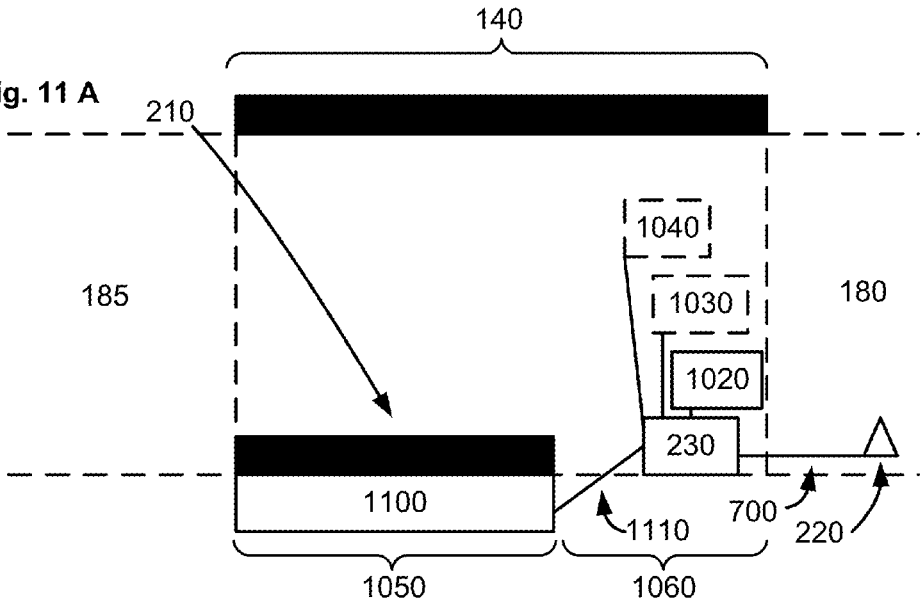
FIG. 11A illustrates aspects of a vapor control unit.
Figure 11B:
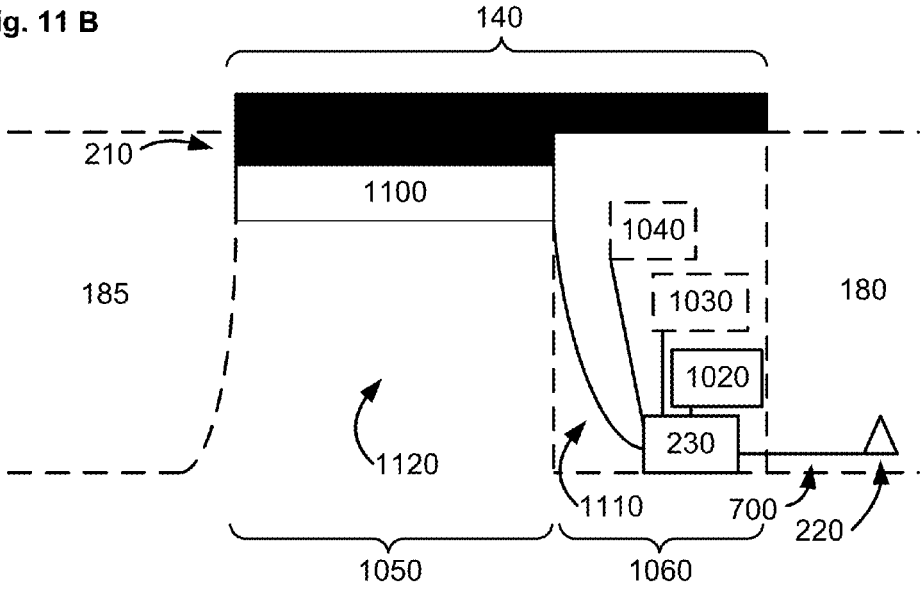
FIG. 11B shows aspects of a vapor control unit.

FIGS. 11A and 11B depict aspects of a vapor control unit 140. The vapor control unit 140 is positioned between the first end 185 and the second end 180 of a vapor conduit. The vapor control unit 140 includes a valve region 1050 and a control region 1060.

The vapor control unit 140 illustrated in FIG. 11A includes a valve region 1050 including a valve 210 and a movable unit 1100. The movable unit 1100 is physically attached to the valve 210 and configured to provide physical force against the valve 210 in response to a stimulus. For example, in some embodiments a movable unit 1100 is a crank mechanism attached to a valve 210. For example, in some embodiments a movable unit 1100 includes a bonnet and a stem attached to a valve interior that includes a disc and a physical seat for the disc. For example, in some embodiments a valve 210 includes a physically deformable region of a conduit, and a movable unit 1100 includes at least two physical elements that are positioned to press against opposing exterior surfaces of the physically deformable region of the conduit in response to a signal from the controller. For example, in some embodiments a valve region 1050 includes a valve 210 with a physically deformable region of a conduit and a movable unit 1100 that includes a reversible clamp on the exterior of the valve, wherein the movable unit 1100 is attached to a controller. In some embodiments, the movable unit 1100 includes a motor. In some embodiments, the movable unit 1100 is entirely internal to the vapor control unit 140. In some embodiments, the movable unit 1100 includes one or more elements that are external to the vapor control unit 140.

The movable unit 1100 is operably attached to the controller 230 within the control region 1060 of the vapor control unit 140. A power source 1020 is attached to the controller 230. The power source 1020 and the controller 230 supply power to the movable unit 1100, for example a motor element of the movable unit 1100, as needed for operation of the movable unit 1100. The controller 230 accepts data from an attached sensor 220 within the first vapor conduit 180. Although the sensor 220 is illustrated in FIGS. 11A and 11B as adjacent to the junction between the vapor control unit 140 and the first vapor conduit 180, in some embodiments the sensor 220 is positioned distal to the junction between the vapor control unit 140 and the first vapor conduit 180. For example, in some embodiments a sensor 220 is positioned adjacent to the substantially thermally sealed storage region within a container. See, e.g. FIG. 5. The sensor 220 is attached to the controller 230 with a wire connector 370 in the embodiment illustrated in FIGS. 11A and 11B. In some embodiments, memory 1030 is connected to the controller 230. In some embodiments, memory 1030 is integrated with the controller 230. Some embodiments include a transmitter 1040 attached to the controller 230. In some embodiments, a transmitter 1040 is integrated with the controller 230.

In the illustration shown in FIGS. 11A and 11B, components of the control region 1060, including the controller 230, the power unit 1020, the memory 1030 and the transmitter 1040 are shown as filling space within the interior of the vapor control unit 140. The components are displayed in an enlarged and distinct manner for ease of visualization. In an actual embodiment, the components of the control region 1060 would not impede vapor flow through the vapor control unit 140. In an actual embodiment, the components illustrated would be smaller than shown. In an actual embodiment, the valve region 1050 of the vapor control unit 140 is the limiting factor for vapor flow between first end 185 of the vapor conduit and the second end 180 of the vapor conduit through the vapor control unit 140.

FIG. 11A illustrates an embodiment of a vapor control unit 140 with the valve 210 in a substantially open position. In the configuration shown in FIG. 11A, the movable unit 1100 attached to the valve 210 is positioned substantially flush with the exterior surface of the vapor control unit 140. This allows for maximum vapor flow between first end 185 of the vapor conduit and the second end 180 of the vapor conduit through the vapor control unit 140. For example, evaporated liquid from the evaporative unit will flow freely through the vapor control unit 140 to the desiccant unit in the configuration shown in FIG. 11A.

FIG. 11B illustrates the same embodiment as shown in FIG. 11A, with the valve 210 in a substantially closed position. In the configuration shown in FIG. 11B, the movable unit 1100 attached to the valve 210 has moved the valve to a position adjacent to the interior surface of the vapor control unit 140. An externally-visible gap 1120 is formed in the vapor control unit 140 when the valve is in the illustrated "closed" position. The position of the movable unit and the valve 210 allows for minimal vapor flow between the first end 185 and the second end 180 of the vapor conduit through the vapor control unit 140. For example, the partial pressure of evaporated liquid from the evaporative unit will increase within the first vapor conduit 140 in the configuration shown in FIG. 11B as the evaporated liquid will not be able to flow through the vapor control unit 140 to the desiccant unit. In some embodiments, a valve 210 of a vapor control unit 140 has one or more intermediate or partially open/partially closed configurations that partially restrict vapor flow through the vapor control unit 140 and between the first end 185 of the vapor conduit 180 and the second end 180 of the vapor conduit.

EXAMPLES

Example 1

A portable cooling unit was constructed from 304 type stainless steel, with a vapor conduit including 1 inch OD stainless steel tubing. The vapor control unit included a right angle solenoid valve (Part SA0100EVQF, Kurt J. Lesker® Company) attached by a wire connection to a PID temperature controller configured in a "bang-bang" mode. An electrical power source was attached to the controller. A capacitance pressure sensor (Baratron®) was positioned within the first end of the vapor conduit and connected to the controller with a wire connection. The portable cooling unit also included a T-type thermocouple attached to the surface of the evaporative cooling unit. The controller was programmed to signal the valve to open when the controller received data indicating that the temperature of the evaporative cooling unit was at 8 degrees Centigrade or above. The controller was programmed to signal the valve to close when the controller received data indicating that the temperature of the evaporative cooling unit was at 7 degrees Centigrade or above.

Prior to the start of the testing, approximately 500 g of desiccant material including calcium chloride (DampRid®, WM Barr & Co) was placed within the desiccant unit of the portable cooling unit. Approximately 500 mL of water was placed within the evaporative cooling unit. The interior of the portable cooling unit was attached to a dual stage rotary vane pump and evacuated to approximately 300 mTorr and then re-sealed prior to the start of testing.

Figure 12:
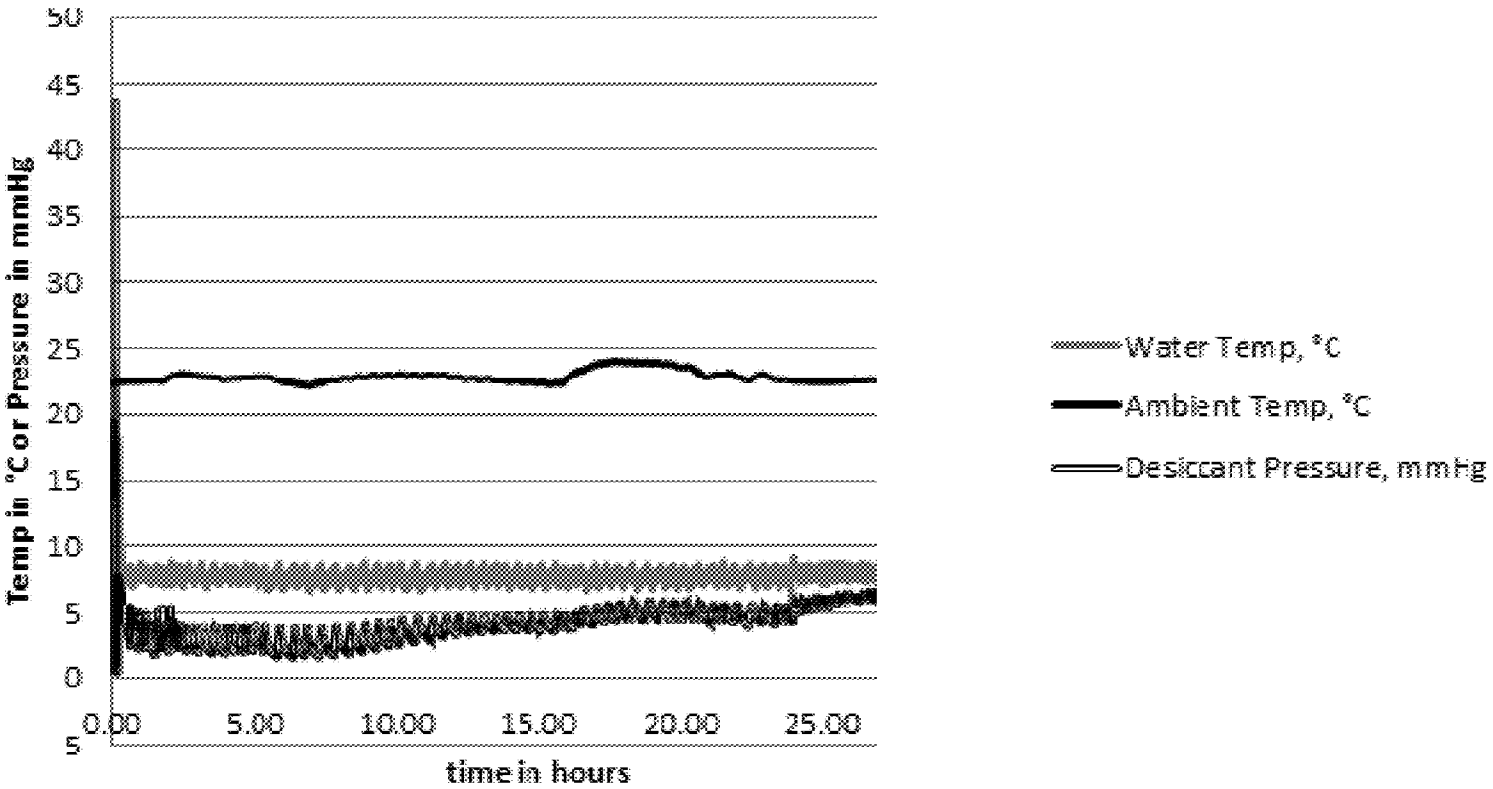
FIG. 12 illustrates testing results.

Test results for approximately the first 25 hours are shown in FIG. 12. FIG. 12 depicts that the ambient temperature external to the portable cooling unit maintained a temperature between 21 degrees Centigrade and 24 degrees Centigrade during the test period (solid black line, "Ambient Temp"). The temperature readings of the T-type thermocouple attached to the surface of the evaporative cooling unit are shown in degrees Centigrade (grey line, "Water Temp"). The temperature readings from the surface of the evaporative cooling unit vary between approximately 7 degrees Centigrade and 8 degrees Centigrade during the test period. The gas pressure readings from the capacitance pressure sensor positioned within the first end of the vapor conduit are shown in mmHg (open black line, "Desiccant Pressure"). The gas pressure readings vary in accord with the line of the temperature readings, based on the opening and closing of the valve by the controller during the testing period. The gas pressure line has a trend upward during the testing period, indicating that some of the desiccant material has become saturated.

Example 2

A portable cooling unit is fabricated from 304 type stainless steel, with a vapor conduit including 1 inch OD stainless steel tubing. The vapor control unit includes a thermostatic expansion valve with a C orifice (Sporlan Division, Parker Hannifin Co.) directly attached to a pressure sensor including an expansion valve with a 60 inch capillary tube and 5 foot element (Sporlan Division, Parker Hannifin Co.).

Prior to attachment of the vapor control unit to the vapor conduit, the vapor control unit is calibrated by flushing the vapor control unit with gas of known temperature and calibrating the valve to be fully open at 8 degrees Centigrade or above, and to gradually close at lower temperatures until the valve is fully closed at temperatures of 2 degrees Centigrade or below. After calibration, the vapor control unit is attached to the vapor conduit with a gas-impermeable seal.

Prior to the start of the testing, approximately 500 g of desiccant material including calcium chloride (DampRid®, WM Barr & Co) is placed within the desiccant unit of the portable cooling unit. Approximately 500 mL of water is placed within the evaporative cooling unit. The interior of the portable cooling unit is attached to a dual stage rotary vane pump and evacuated to approximately 300 mTorr and then re-sealed prior to the start of testing.

In some implementations described herein, logic and similar implementations may include computer programs or other control structures. Electronic circuitry, for example, may have one or more paths of electrical current constructed and arranged to implement various functions as described herein. In some implementations, one or more media may be configured to bear a device-detectable implementation when such media hold or transmit device detectable instructions operable to perform as described herein. In some variants, for example, implementations may include an update or modification of existing software or firmware, or of gate arrays or programmable hardware, such as by performing a reception of or a transmission of one or more instructions in relation to one or more operations described herein. Alternatively or additionally, in some variants, an implementation may include special-purpose hardware, software, firmware components, and/or general-purpose components executing or otherwise invoking special-purpose components.

The subject matter described herein may be implemented in an analog or digital fashion or some combination thereof.

In a general sense, some aspects described herein can be implemented, individually and/or collectively, by a wide range of hardware, software, firmware, and/or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), and/or electrical circuitry forming a communications device (e.g., a modem, communications switch, optical-electrical equipment, etc.).

Alternatively or additionally, implementations may include executing a special-purpose instruction sequence or invoking circuitry for enabling, triggering, coordinating, requesting, or otherwise causing one or more occurrences of virtually any functional operation described herein. In some variants, operational or other logical descriptions herein may be expressed as source code and compiled or otherwise invoked as an executable instruction sequence. In some contexts, for example, implementations may be provided, in whole or in part, by source code, such as C++, or other code sequences. In other implementations, source or other code implementation, using commercially available and/or techniques in the art, may be compiled/implemented/translated/converted into a high-level descriptor language (e.g., initially implementing described technologies in C or C++ programming language and thereafter converting the programming language implementation into a logic-synthesizable language implementation, a hardware description language implementation, a hardware design simulation implementation, and/or other such similar mode(s) of expression). For example, some or all of a logical expression (e.g., computer programming language implementation) may be manifested as a Verilog-type hardware description (e.g., via Hardware Description Language (HDL) and/or Very High Speed Integrated Circuit Hardware Descriptor Language (VHDL)) or other circuitry model which may then be used to create a physical implementation having hardware (e.g., an Application Specific Integrated Circuit).

In a general sense, various aspects of the embodiments described herein can be implemented, individually and/or collectively, by various types of electro-mechanical systems having a wide range of electrical components such as hardware, software, firmware, and/or virtually any combination thereof, limited to patentable subject matter under 35 U.S.C. 101; and a wide range of components that may impart mechanical force or motion such as rigid bodies, spring or torsional bodies, hydraulics, electro-magnetically actuated devices, and/or virtually any combination thereof. Consequently, as used herein "electro-mechanical system" includes, but is not limited to, electrical circuitry operably coupled with a transducer (e.g., an actuator, a motor, a piezoelectric crystal, a Micro Electro Mechanical System (MEMS), etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of memory (e.g., random access, flash, read only, etc.)), electrical circuitry forming a communications device (e.g., a modem, communications switch, optical-electrical equipment, etc.), and/or any non-electrical analog thereto, such as optical or other analogs (e.g., graphene based circuitry). Examples of electro-mechanical systems include, but are not limited to, a variety of consumer electronics systems, medical devices, as well as other systems such as motorized transport systems, factory automation systems, security systems, and/or communication/computing systems.

At least a portion of the devices and/or processes described herein can be integrated into a data processing system. A data processing system generally includes one or more of a system unit housing, a video display device, memory such as volatile or non-volatile memory, processors such as microprocessors or digital signal processors, computational entities such as operating systems, drivers, graphical user interfaces, and applications programs, one or more interaction devices (e.g., a touch pad, a touch screen, an antenna, etc.), and/or control systems including feedback loops and control motors (e.g., feedback for sensing position and/or velocity; control motors for moving and/or adjusting components and/or quantities). A data processing system may be implemented utilizing suitable commercially available components, such as those typically found in data computing/communication and/or network computing/communication systems.

The state of the art has progressed to the point where there is little distinction left between hardware, software, and/or firmware implementations of aspects of systems; the use of hardware, software, and/or firmware is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware in one or more machines, compositions of matter, and articles of manufacture, limited to patentable subject matter under 35 USC 101. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components, and/or wirelessly interactable, and/or wirelessly interacting components, and/or logically interacting, and/or logically interactable components. In some instances, one or more components may be referred to herein as "configured to," "configured by," "configurable to," "operable/operative to," "adapted/adaptable," "able to," "conformable/conformed to," etc. Such terms (e.g. "configured to") generally encompass active-state components and/or inactive-state components and/or standby-state components, unless context requires otherwise.

The herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

While particular aspects of the present subject matter described herein have been shown and described, changes and modifications may be made without departing from the subject matter described herein and its broader aspects and, therefore, the appended claims are to encompass within their scope all such changes and modifications as are within the true spirit and scope of the subject matter described herein. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). If a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended as "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended as "a system having at least one of A, B, or C" that would include but not be limited to systems that have A alone, B alone, C alone, A and B together, A and C together, B and C together, and/or A, B, and C together, etc. Typically, a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

While various aspects and embodiments have been disclosed herein, other aspects and embodiments will be apparent. The various aspects and embodiments disclosed herein are for purposes of illustration and are not intended to be limiting, with the true scope and spirit being indicated by the following claims.

What is claimed is:

1. A portable cooling unit configured for use with a storage container, comprising:

a desiccant unit including at least one exterior wall substantially defining an interior desiccant region, wherein the interior desiccant region is substantially sealed from gas transfer between the interior desiccant region and a region external to the portable cooling unit;

an evaporative cooling unit including at least one exterior wall substantially defining an interior evaporative region, wherein the interior evaporative region is substantially sealed from gas transfer between the interior evaporative region and the region external to the portable cooling unit;

a vapor conduit including a first end and a second end, the vapor conduit attached to the desiccant unit at the first end, the vapor conduit attached to the evaporative cooling unit at the second end, the vapor conduit forming an internal, gas-impermeable passageway between the interior desiccant region and the interior evaporative region; and a vapor control unit attached to the vapor conduit.

2. The portable cooling unit of claim 1, wherein the at least one exterior wall of the desiccant unit comprises:

an aperture in the exterior wall, the aperture positioned adjacent to an interior of the vapor conduit, the first end of the vapor conduit sealed to the exterior wall at a surface surrounding the aperture.

3. The portable cooling unit of claim 1, wherein the desiccant unit comprises:

a vapor-sealed chamber including an interior desiccant region in vapor contact with an interior region of the vapor conduit.

4. The portable cooling unit of claim 1, wherein the desiccant unit further comprises:

a heating element positioned adjacent to an interior surface of the internal desiccant region; and a power unit operably connected to the heating element.

5. The portable cooling unit of claim 1, wherein the desiccant unit further comprises:

a one-way valve unit, the one-way valve unit configured allow gas with a pressure beyond a preset limit to vent externally from the internal desiccant region of the desiccant unit.

6. The portable cooling unit of claim 1, wherein the desiccant unit further comprises:

a one-way valve unit, the one-way valve unit configured allow gas with a temperature beyond a preset limit to vent externally from the internal desiccant region of the desiccant unit.

7. The portable cooling unit of claim 1, wherein the desiccant unit comprises:

a gas pressure less than atmospheric pressure within the interior desiccant region.

8. The evaporative cooling unit of claim 1, further comprising:

a liquid retaining unit connected to at least one surface adjacent to the interior evaporative region.

9. The portable cooling unit of claim 1, wherein the vapor conduit comprises:

a gas-impermeable wall of the vapor conduit;

a gas-impermeable seal between the first end of the vapor conduit and the desiccant unit; and a gas-impermeable seal between the second end of the vapor conduit and the evaporative cooling unit.

10. The portable cooling unit of claim 1, wherein the vapor conduit further comprises:

an externally-breakable seal across the internal passageway of the vapor conduit, the seal configured to prevent the flow of gas through the internal passageway of the vapor conduit.

11. The portable cooling unit of claim 1, wherein the vapor control unit comprises:

at least one valve configured to control movement of gas through the internal passageway of the vapor conduit between the interior desiccant region of the desiccant unit and the interior evaporative region of the evaporative cooling unit;

a controller operably connected to the at least one valve; and a sensor attached to the controller.

12. The portable cooling unit of claim 1, wherein the vapor control unit comprises:

a thermocouple unit configured to respond to the temperature of vapor in the vapor conduit;

a valve configured to regulate vapor flow through the vapor control unit; and a controller operably connected to the thermocouple unit and to the valve.

13. The portable cooling unit of claim 1, comprising:

a persistent gas pressure below atmospheric pressure within the interior desiccant region of the desiccant unit, the interior evaporative region of the evaporative unit, and the internal, gas-impermeable passageway of the vapor conduit.

14. The portable cooling unit of claim 1, further comprising:

a display unit operably attached to the vapor conduit.

15. The portable cooling unit of claim 1, further comprising:

a display unit operably attached to the vapor control unit.

16. The portable cooling unit of claim 1, further comprising:

a user input device operably attached to the vapor control unit.

17. A portable cooling unit configured for use with a storage container, comprising:

a desiccant unit including one or more external walls, the one or more external walls sealed together to form a gas-impermeable barrier around an interior desiccant region, the one or more external walls including an aperture;

an evaporative cooling unit including one or more external walls, the one or more external walls sealed together to form a gas-impermeable barrier around an interior evaporative region, the one or more external walls including an aperture;

a vapor conduit including a first end and a second end, the vapor conduit attached to an external surface of the one or more external walls surrounding the aperture of the desiccant unit at the first end, the vapor conduit attached to an external surface of the one or more external walls surrounding the aperture of the evaporative cooling unit at the second end, the vapor conduit forming an internal, gas-impermeable passageway between the interior desiccant region of the desiccant unit and the interior evaporative region of the evaporative cooling unit; and a vapor control unit attached to the vapor conduit.

18. The portable cooling unit of claim 17, wherein the desiccant unit comprises:

a heating element positioned adjacent to an interior surface of the interior desiccant region; and a power unit operably connected to the heating element.

19. The portable cooling unit of claim 17, wherein the desiccant unit further comprises:

a one-way valve unit, the one-way valve unit configured to allow gas of a pressure beyond a preset limit to vent externally from the desiccant unit.

20. The portable cooling unit of claim 17, wherein the desiccant unit further comprises:

a one-way valve unit, the one-way valve unit configured to allow gas of a temperature beyond a preset limit to vent externally from the desiccant unit.

21. The portable cooling unit of claim 17, wherein the evaporative cooling unit further comprises:

a liquid retaining unit connected to at least one surface adjacent to the interior evaporative region.

22. The portable cooling unit of claim 17, wherein the vapor conduit comprises:

a gas-impermeable seal between the first end of the vapor conduit and the desiccant unit; and a gas-impermeable seal between the second end of the vapor conduit and the evaporative cooling unit.

23. The portable cooling unit of claim 17, wherein the vapor conduit further comprises:

an externally-breakable seal across the internal, gas-impermeable passageway of the vapor conduit, the seal configured to prevent the flow of gas through the internal, gas-impermeable passageway of the vapor conduit.

24. The portable cooling unit of claim 17, wherein the vapor control unit comprises:

a valve configured to restrict the transfer of gas between the first end of the vapor conduit and the second end of the vapor conduit.

25. The portable cooling unit of claim 17, wherein the vapor control unit comprises:

at least one valve configured to control the movement of gas through the internal, gas-impermeable passageway of the vapor conduit between the interior desiccant region of the desiccant unit and the interior evaporative region of the evaporative cooling unit;

a controller operably connected to the at least one valve; and a sensor operably connected to the controller.

26. The portable cooling unit of claim 25, wherein the sensor is a temperature sensor.

27. The portable cooling unit of claim 17, wherein the vapor control unit comprises:

a thermocouple unit configured to respond to the temperature of vapor in the vapor conduit;

a valve configured to regulate vapor flow through the vapor control unit; and a controller operably connected to the thermocouple unit and to the valve.

28. The portable cooling unit of claim 17, further comprising:

a display unit operably attached to the vapor conduit.

29. The portable cooling unit of claim 17, further comprising:

a display unit operably attached to the vapor control unit.

30. The portable cooling unit of claim 17, further comprising:

a user input device operably attached to the vapor control unit.

31. A portable cooling unit configured for use with a storage container, comprising:

a desiccant unit including one or more external walls forming a substantially elongated structure around an interior desiccant region, the substantially elongated structure including an aperture proximal to one end;

an evaporative cooling unit including one or more external walls forming a substantially elongated structure around an interior evaporative region, the substantially elongated structure including an aperture proximal to one end;

a vapor conduit including a first end and a second end, the vapor conduit attached to an external surface surrounding the aperture of the desiccant unit at the first end, the vapor conduit attached to an external surface surrounding the aperture of the evaporative cooling unit at the second end, the vapor conduit forming an internal, gas-impermeable passageway between the interior desiccant region of the desiccant unit and the interior evaporative region of the evaporative cooling unit; and a vapor control unit integral to the vapor conduit.

32. The portable cooling unit of claim 31, wherein the desiccant unit further comprises:

a heating element positioned adjacent to an interior surface of the internal desiccant region; and a power unit operably connected to the heating element.

33. The portable cooling unit of claim 31, wherein the desiccant unit further comprises:

a one-way valve unit proximal to the aperture, the one-way valve unit configured for release of gas with pressure beyond a preset limit to vent externally from the interior desiccant region within the desiccant unit.

34. The portable cooling unit of claim 31, wherein the desiccant unit comprises:

a gas pressure less than atmospheric pressure within the interior desiccant region.

35. The portable cooling unit of claim 31, wherein the evaporative cooling unit further comprises:

a liquid retaining unit connected to at least one surface adjacent to the interior evaporative region.

36. The portable cooling unit of claim 31, wherein the vapor conduit comprises:

a gas-impermeable seal between the first end of the vapor conduit and the desiccant unit; and a gas-impermeable seal between the second end of the vapor conduit and the evaporative cooling unit.

37. The portable cooling unit of claim 31, wherein the vapor conduit further comprises:

an externally-breakable seal across the internal, gas-impermeable passageway of the vapor conduit, the seal configured to prevent the flow of gas through the internal, gas-impermeable passageway of the vapor conduit.

38. The portable cooling unit of claim 31, wherein the vapor control unit comprises:

at least one valve configured to control the movement of gas through the internal, gas-impermeable passageway of the vapor conduit between the interior desiccant region of the desiccant unit and the interior evaporative region of the evaporative cooling unit;

a controller operably connected to the at least one valve; and a sensor attached to the controller.

39. The portable cooling unit of claim 38, wherein the sensor is a temperature sensor.

40. The portable cooling unit of claim 31, wherein the vapor control unit comprises:

a thermocouple unit configured to respond to the temperature of vapor in the vapor conduit;

a valve configured to regulate vapor flow through the vapor control unit; and a controller operably connected to the thermocouple unit and to the valve.

41. The portable cooling unit of claim 31, further comprising:

a display unit operably attached to the vapor conduit.

42. The portable cooling unit of claim 31, further comprising:

a display unit operably attached to the vapor control unit.

43. The portable cooling unit of claim 31, further comprising:

a user input device operably attached to the vapor control unit.

* * * * *